US008986471B2

(12) United States Patent
Oishi

(10) Patent No.: US 8,986,471 B2
(45) Date of Patent: Mar. 24, 2015

(54) HIGH STRENGTH AND HIGH THERMAL CONDUCTIVITY COPPER ALLOY TUBE AND METHOD FOR PRODUCING THE SAME

(75) Inventor: Keiichiro Oishi, Tokyo (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 653 days.

(21) Appl. No.: 12/514,680

(22) PCT Filed: Nov. 10, 2008

(86) PCT No.: PCT/JP2008/070410

§ 371 (c)(1),
(2), (4) Date: May 13, 2009

(87) PCT Pub. No.: WO2009/081664

PCT Pub. Date: Jul. 2, 2009

(65) Prior Publication Data

US 2011/0056596 A1 Mar. 10, 2011

(30) Foreign Application Priority Data

Dec. 21, 2007 (JP) ..... 2007-331080

(51) Int. Cl.
*B21C 1/00* (2006.01)
*C22C 9/06* (2006.01)
(Continued)

(52) U.S. Cl.
CPC . *C22C 9/06* (2013.01); *B21C 1/003* (2013.01); *B21C 23/002* (2013.01); *B21C 23/085* (2013.01); *C22C 9/02* (2013.01); *F28F 21/085* (2013.01); *C22F 1/08* (2013.01)
USPC ..... 148/433; 420/472

(58) Field of Classification Search
USPC ..... 148/433; 420/472
IPC ..... B21C 1/003,23/002, 23/085; C22C 9/02, C22C 9/06
See application file for complete search history.

(56) References Cited

U.S. PATENT DOCUMENTS 2,074,713 A 3/1937 Tross
4,073,667 A 2/1978 Caron et al.
(Continued)

FOREIGN PATENT DOCUMENTS

CN 1546701 A 11/2004
CN 1693502 A 11/2005
(Continued)

OTHER PUBLICATIONS

International Search Report issued in corresponding application No. PCT/JP2008/070410, completed Jan. 23, 2009 and mailed Feb. 10, 2009.
(Continued)

*Primary Examiner* — Sikyin Ip
(74) *Attorney, Agent, or Firm* — Griffin & Szipl, P.C.

(57) ABSTRACT

A high strength and high thermal conductivity copper alloy tube contains: Co of 0.12 to 0.32 mass %; P of 0.042 to 0.095 mass %; and Sn of 0.005 to 0.30 mass %, wherein a relationship of $3.0 \leq ([Co]-0.007)/([P]-0.008) \leq 6.2$ is satisfied between a content [Co] mass % of Co and a content [P] mass % of P, and the remainder includes Cu and inevitable impurities. Even when a temperature is increased by heat generated by a drawing process, a recrystallization temperature is increased by uniform precipitation of a compound of Co and P and by solid-solution of Sn. Thus, the generation of recrystallization nucleuses is delayed, thereby improving heat resistance and pressure resistance of the high strength and high thermal conductivity copper alloy tube.

22 Claims, 4 Drawing Sheets

(51) Int. Cl.

| | |
|---|---|
| ***C22F 1/08*** | (2006.01) |
| ***B21C 23/00*** | (2006.01) |
| ***B21C 23/08*** | (2006.01) |
| ***C22C 9/02*** | (2006.01) |
| ***F28F 21/08*** | (2006.01) |

(56) References Cited

U.S. PATENT DOCUMENTS

| | | | | |
|---|---|---|---|---|
| 4,260,432 | A | 4/1981 | Plewes | |
| 4,388,270 | A | 6/1983 | Stavish et al. | |
| 4,427,627 | A | 1/1984 | Guerlet et al. | |
| 4,666,667 | A | 5/1987 | Kamio et al. | |
| 5,004,498 | A | 4/1991 | Shimamura et al. | |
| 5,322,575 | A | 6/1994 | Endo et al. | |
| 5,814,168 | A | 9/1998 | Hatakeyama et al. | |
| 6,132,529 | A | 10/2000 | Hatakeyama et al. | |
| 7,608,157 | B2 * | 10/2009 | Oishi | 148/433 |
| 7,928,541 | B2 | 4/2011 | Miwa et al. | |
| 2006/0016528 | A1 | 1/2006 | Hatakeyama | |
| 2006/0260721 | A1 * | 11/2006 | Oishi | 148/433 |
| 2007/0051442 | A1 | 3/2007 | Yamamoto et al. | |
| 2009/0014102 | A1 | 1/2009 | Hatakeyama | |
| 2010/0008817 | A1 | 1/2010 | Ando | |
| 2010/0047112 | A1 | 2/2010 | Fugono et al. | |
| 2010/0206513 | A1 | 8/2010 | Hattori et al. | |
| 2010/0297464 | A1 | 11/2010 | Oishi | |
| 2011/0056596 | A1 | 3/2011 | Oishi | |
| 2011/0100676 | A1 | 5/2011 | Oishi | |
| 2011/0200479 | A1 | 8/2011 | Mihara et al. | |

FOREIGN PATENT DOCUMENTS

| | | | | |
|---|---|---|---|---|
| EP | 1630240 | A1 | | 3/2006 |
| JP | 60-245753 | A | | 12/1985 |
| JP | 60-245754 | A | | 12/1985 |
| JP | 63-65039 | A | | 3/1988 |
| JP | 01-108322 | A | | 4/1989 |
| JP | 04-272148 | A | | 9/1992 |
| JP | 06-094390 | A | | 4/1994 |
| JP | 10-130754 | A | * | 5/1998 |
| JP | 10-168532 | | | 6/1998 |
| JP | 11-97609 | A | | 4/1999 |
| JP | 11-256255 | | | 9/1999 |
| JP | 2001-214226 | A | | 8/2001 |
| JP | 2001-316742 | | | 11/2001 |
| JP | 2001-316742 | A | * | 11/2001 |
| JP | 2003-268467 | | | 9/2003 |
| JP | 2004-137551 | | | 5/2004 |
| JP | 2004-292917 | A | | 10/2004 |
| TW | 200417616 | | | 9/2004 |
| TW | 200706660 | | | 2/2007 |
| WO | 2004/079026 | A1 | | 9/2004 |
| WO | 2007-139213 | A1 | | 12/2007 |
| WO | 2008/099892 | A1 | | 8/2008 |
| WO | 2009/107586 | A1 | | 9/2009 |

OTHER PUBLICATIONS

International Search Report issued in related application PCT/JP2009/071606, completed Mar. 19, 2010 and mailed Apr. 6, 2010.

International Search Report issued in application No. PCT/JP2009/071599, completed Mar. 19, 2010 and mailed Apr. 6, 2010.

Espacenet English Abstract of JP 10-130754 (filed as Exhibit A1 in related U.S. Appl. No. 12/555,990), modified 2011.

Definition of Tensile Strength, at http://metals.about.com/library/bldef-Tensile-Strength.htm (2002), (filed as Exhibit A2 in related U.S. Appl. No. 12/555,990).

"Definition of Hardness," at http://metals.about.com/library/bldef-Hardness.htm (2002), (filed as Exhibit A3 in related U.S. Appl. No. 12/555,990).

"Definition of Proof Stress," at http://metals.about.com/library/bldef-Proof-Stress.htm (2002), (filed as Exhibit A4 in related U.S. Appl. No. 12/555,990).

Pierre Leroux, Breakthrough Indentation Yield Strength Testing (Nanovea 2011), (filed as Exhibit A5 in related U.S. Appl. No. 12/555,990).

Standards Handbook: Part 2—Alloy Data, Wrought Copper and Copper Alloy Mill Products 34 and 38 (Copper Development Association, Inc. 1985), (filed as Exhibit A8 in related U.S. Appl. No. 12/555,990).

Yield Strength—Strength(Mechanics) of Materials, at http://www.engineersedge.com/material_science/yield_strength.htm (downloaded Apr. 18, 2012), two pages.

J.R. Davies (ed.), ASM Specialty Handbook Copper and Copper Alloys 8-9 (ASM International), filed as Exhibit A, 2001.

E. Paul Degarmo et al., Materials and Processes in Manufacturing 402-404, 432-434, 989-998 (John Wiley & Sons, Inc. 2003).

Data Sheet No A 6 Cu-DHP, Consel International Pour Le Developpement Du Cuivre, pp. 1, 2 and 4 (1968) submitted a related application as Exhibit B.

Copper Parts Data Book, pp. 88 and 94 (1997), submitted in a related application as Exhibit C.

International Search Report issued in application No. PCT/JP2009/053216, completed May 19, 2009 and mailed May 26, 2009.

JP 10-130754 A with Espacenet English Abstract, which is "Exhibit B;", May 19, 1998.

JP 2001-316742 A with Espacenet English Abstract, which is "Exhibit C;", Nov. 16, 2011.

J.R. Davies (ed.), ASM Specialty Handbook Copper and Copper Alloys 243-247 (ASM International 2001), which is "Exhibit D".

Office Action issued in related Taiwanese application 097143579 on Oct. 24, 2012.

E. Paul Degarmo et al., Materials and Processes in Manufacturing 383-384 (9th ed. 2003), filed in a related application as Exhibit A1.

Copper and Copper Alloys, ASM Specialty Handbook, no concise explanation and place of publication Materials Park, OH 44073-0002, pp. 3-4, and 454 (2001).

Fundamentals of Rockwell Hardness Testing, www.wilsonsinstrumenets.com, 2004, pp. 1-15.

Annual Book of ASTM Standards, Designation: B 359-93, vol. 02.01, 480-486 and 514-521 (1994), filed herewith as Exhibit A1.

* cited by examiner

FIG. 3A

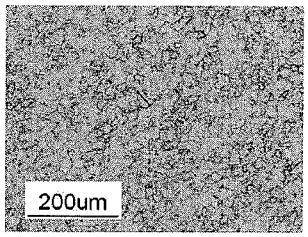

FIRST INVENTION ALLOY, TEST No. 1
PROCESS CENTER PORTION, 14 μm

FIG. 3B

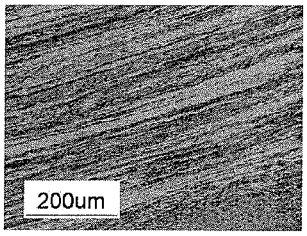

FIRST INVENTION ALLOY, TEST No. 1
PROCESS END PORTION,
NON-RECRYSTALLIZATION

FIG. 3C

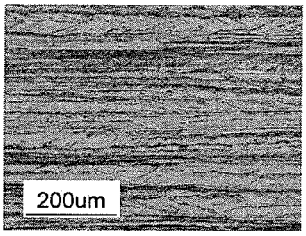

FIRST INVENTION ALLOY, TEST No. 1
HEAT-INFLUENCED PORTION,
NON-RECRYSTALLIZATION

FIG. 3D

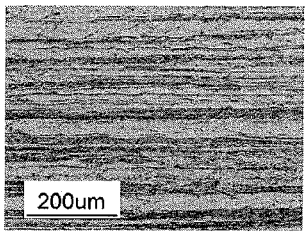

FIRST INVENTION ALLOY, TEST No. 1
STRAIGHT TUBE PORTION,
NON-RECRYSTALLIZATION

FIG. 3E

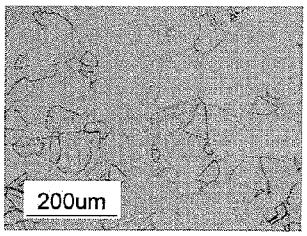

C1220, TEST No. 14
PROCESS CENTER PORTION, 120 μm

FIG. 3F

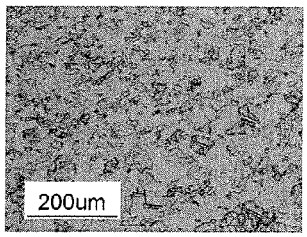

C1220, TEST No. 14
PROCESS END PORTION, 32 μm

FIG. 3G

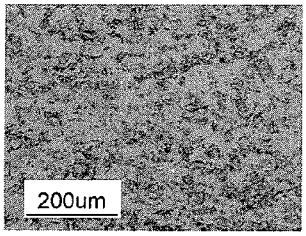

C1220, TEST No. 14
HEAT-INFLUENCED PORTION, 17 μm

FIG. 3H

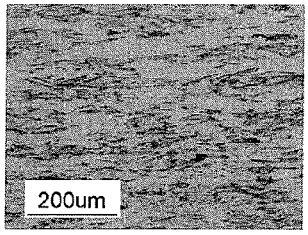

C1220, TEST No. 14
STRAIGHT TUBE PORTION,
NON-RECRYSTALLIZATION

FOURTH INVENTION ALLOY, TEST No. 7
PROCESS CENTER PORTION, 12nm

FIRST INVENTION ALLOY, TEST No. 1
PROCESS END PORTION, 3.5nm

HIGH STRENGTH AND HIGH THERMAL CONDUCTIVITY COPPER ALLOY TUBE AND METHOD FOR PRODUCING THE SAME

This is a National Phase Application in the United States of International Patent Application No. PCT/JP2008/70410 filed Nov. 10, 2008, which claims priority from Japanese Patent Application No. 2007-331080, filed Dec. 21, 2007. The entire disclosures of the above patent applications are hereby incorporated by reference.

BACKGROUND OF THE INVENTION

1. Field of the Invention

The invention relates to a drawing-processed high strength and high thermal conductivity copper alloy tube and a method for producing the same.

2. Description of Related Art

Copper having excellent thermal conductivity has been used for tube members (hereinafter, referred to as a pressure-resistance and heat-transfer vessel in the general term) such as a header, a distribution joint, a dryer, a muffler, a filter, and an accumulator used for heat exchangers for such as a refrigerator, a freezer, an air conditioner, and a boiler, since previous times. Generally, a high strength and high thermal conductivity copper alloy tube (hereinafter, referred to as a high function copper tube) made of phosphorus deoxidized copper (JIS C1220) based on pure copper excellent in thermal conductivity, heat resistance, and brazing property have been used. The pressure-resistance and heat-transfer vessels are pressure vessels having a shape in which both ends or one end of the high function copper tube are drawn. An outer diameter of the pressure-resistance and heat-transfer vessels is 1.5 or more times as large as that of the tubes made of phosphorus deoxidized copper and the like connected to the pressure-resistance and heat transfer vessels, and a refrigerant or the like passes through the inside thereof. Accordingly, high internal pressure is applied to the pressure-resistance and heat-transfer vessel. Heat resistance represents that something is hardly recrystallized even if heated at a high temperature, or that crystal grains hardly grow although a few might be recrystallized, thereby keeping high strength. Specifically, copper alloy having high heat resistance is hardly recrystallized and the strength thereof slightly decreases, even when the copper alloy is heated to about 400° C., which is a recrystallization temperature of pure copper, and even when the copper alloy is heated to 600° C. to 700° C. at which crystal grains of pure copper, start coarsening and strength thereof decreases. In addition, when the copper alloy is heated to about 800° C. or higher at which crystal grains of pure copper are significantly coarsened, the copper alloy is recrystallized. However, the crystal grains of the copper alloy are fine, and the copper alloy has high strength.

Processes for producing the high function copper tube are as follows. [1] Cast cylindrical ingot (billet, outer diameter: about 200 mm to about 300 mm) is heated to 770 to 970° C., and then is hot-extruded (outer diameter: 100 mm, thickness: 10 mm). [2] Immediately after the extrusion, the ingot is air-cooled or water-cooled in the temperature range from 850° C. or the temperature of the extrusion tube after the extrusion to 600° C. at an average cooling rate of 10 to 3000° C./second. [3] Afterwards, in regards to a cold state, a tube is produced with an outer diameter of about 12 to 75 mm and a thickness of about 0.3 to 3 mm by tube rolling (processed by a cold reducer, etc.) or drawing (processed by bull block, combining, die drawing, etc.). Mostly, in the course of the process of the tube rolling or the drawing, a heat treatment is not performed. However, there is a case in which annealing is performed thereon at 400 to 750° C. for 0.1 to 10 hours. In addition, there is a method of obtaining an unprocessed tube from a cylindrical continuous cast having an outer diameter of 50 to 200 mm by in a tube rolling method processed in a hot state of about 770° C. or higher or by the Mannesmann method, instead of the hot extruding, using the heat generated by the plastic working process, thereby obtaining a tube member having the size obtained in a cold state as described above. Finally, both ends or one end of the tube member obtained by the tube rolling or the drawing are drawn by a spinning process or the like, thereby producing a pressure-resistance and heat-transfer vessel.

FIG. 1 shows a side section of the pressure-resistance and heat-transfer vessel. In the specification, terms of parts of the pressure-resistance and heat-transfer vessel 1 drawn by the spinning process are defined as follows. An outer diameter of an unprocessed tube that is not spinning-processed is defined as D.

UNPROCESSED TUBE PORTION 2: A part that is not spinning-processed.

DRAWING TUBE PORTION 3: A part that is drawn with a predetermined diameter by a spinning process.

PROCESS CENTER PORTION 4: The drawing tube portion and a part within a half of a distance from the drawing tube portion to an outer periphery of the unprocessed tube portion.

PROCESS END PORTION 5: A part within a distance D/6 from the outer periphery inward in the end surface of the unprocessed tube portion. Thicknesses of the drawing tube portion 3, the process center portion 4, and the process end portion 5 are 2 to 3 times of the thickness of the unprocessed tube at the thickest part by a spinning process. The thickness of the process end portion gets thinner toward the end of the process end portion.

HEAT-INFLUENCED PORTION 6: In the unprocessed tube portion, a part within a distance D/6 from the process end portion toward the unprocessed tube portion, assuming a part where the temperature is increased to 500° C. or higher by process heat. A part where the temperature is not increased to 500° C. or higher is not included in the heat-influenced portion.

STRAIGHT TUBE PORTION 7: A part of the center of the unprocessed tube portion from a part within a distance D/2 from the process end portion toward the unprocessed tube portion, assuming a part where the temperature is not increased to 500° C. or higher by process heat.

DRAWING-PROCESSED PORTION 8: a part including both of the process end portion 5 and the heat-influenced portion 6.

Terms of parts of the pressure-resistance and heat-transfer vessel that is subjected to drawing by "Hera-shibori" ("hera" represents a jig in the shape of rods or plates, or a metallic spatula, which is pressed against the spinning material to shape, and "shibori" means drawing), swaging, or the like are defined in the same manner described above. When heat is not generated by the drawing process, the heat-influenced portion is a part within a distance D/6 from the process end portion toward the unprocessed tube portion. In the specification, a drawing process such as a "Hera-shibori" process, a swaging process, and a roll forming process, in which little heat is generated, is defined as a cold-drawing process.

In a spinning process for producing a pressure-resistance and heat-transfer vessel having a general shape, a material temperature of a processed portion reaches a high temperature of 700 to 950° C. by process heat. The process center portion 4 drawn by the spinning process is heated to 800° C.

or higher and thus is recrystallized, thereby decreasing strength. Since the thickness of the process center portion 4 becomes large and the outer diameter becomes small, the process center portion 4 stands against internal pressure. However, pressure resistance of the process end portion 5 and the heat-influenced portion 6 is low, since the strength thereof is decreased by restoration and recrystallization and the thickness thereof is not increased with the large outer diameter. Particularly, in the pressure-resistance and heat-transfer vessel having a large outer diameter, since pressure resistance is decreased in proportion to a reciprocal of the outer diameter, the thickness needs to be large. Since a phosphorus deoxidized copper tube used for a piping system connected to the pressure-resistance and heat-transfer vessel has an outer diameter of about 10 mm, a thickness of a pressure-resistance and heat-transfer vessel having an outer diameter of, for example, about 25 mm or 50 mm needs to be 2.5 times or 5 times of the thickness of the copper tube. C1220 of phosphorus deoxidized copper, which has been used for pressure-resistance and heat-transfer vessels since previous times, is easily recrystallized when a temperature thereof becomes high at the time of processing. When the temperature becomes 700° C. or higher even for a moment, crystal gains thereof are coarsened, thereby decreasing the strength.

The pressure-resistance and heat-transfer vessel is not used alone, and is used by connection with another member. The connected member is mostly a copper tube. The connection with the copper tube is performed mostly by brazing. In the brazing process, since the copper tube is excellent in heat conductivity, the copper tube is preheated widely. At the time of the connection, the process center portion 4 of the pressure-resistance and heat-transfer vessel is heated to about 800° C. or higher, which is a melting point of a general brazing material, for example, phosphorus copper lead containing 7% P. Accordingly, the process end portion 5, or the heat-influenced portion 6 as the case may be, is exposed to a high temperature of about 700° C. For this reason, a material that can stand against the heat influence at the time of the spinning process or the brazing process is necessary. Specifically, the brazing of the pressure-resistance and heat-transfer vessel, the copper tube, or the like is performed generally manually, the time of the high temperature heating is about 10 seconds and at most 20 seconds, and a material having high heat resistance is required so that the process end portion 5 and the heat-influenced portion 6 can withstand a high temperature (about 700° C.) during the time.

In the spinning process, a die or a roller is rotated at a high speed to perform drawing, and thus strength is necessary. As a material thereof, a material processed and hardened by tube rolling or drawing is used. The time of the spinning process is several seconds to several tens seconds, at most 20 seconds, and the material is greatly deformed within a short period. Accordingly, at a high temperature during the process, the material needs to be soft and satisfactorily flexible. A method for processing a drawing copper tube is represented by a spinning process of forming in a hot state. However, as described above, there is the cold-drawing processing method such as the "Hera-shibori" and the swaging of forming in a cold state. In the cold-drawing process, a long time is required since it is a cold-forming process as compared with the spinning process, but is advantageous in costs such as reduction of used materials since the thickness of the unprocessed tube portion 2 and the thickness of the drawing tube portion 3 are substantially equal to each other. However, the drawing-processed copper tube formed in a cold state has low productivity, and there is a problem in pressure resistance since the thickness of the process center portion 4 or the process end portion 5 is small. In addition, since the thickness is small, the temperature of the drawing-processed portion 8 at the time of the brazing increases as compared with the spinning process. For this reason, the drawing copper tube formed in a cold state needs to withstand increase in temperature at the time of connecting with another copper tube by the brazing, as compared with the drawing tube produced by the spinning process.

Recently, $CO_2$ or HFC-based Freon tends to be used as a heat medium gas for a heat exchanger such as a boiler and an air-conditioner to prevent the global warming and the destruction of the ozone layer, instead of the conventionally used HCFC-based Freon. When a natural refrigerant such as HFC-based Freon and particularly $CO_2$ is used as a heat medium, a condensation pressure needs to be increased as compared with the case of using the HCFC-based Freon gas. To withstand condensation pressure, it is necessary to further increase the thickness of the pressure-resistance and heat-transfer vessel.

When the thickness of the pressure-resistance and the heat-transfer vessel increases and thus the weight thereof increases, the cost also increases. For structural reasons and to prevent vibration, a member for fixing the pressure-resistance and heat-transfer vessel needs to be strengthened, and thus the cost further increases. Since the amount of the drawing process for producing the pressure-resistance and heat transfer vessel is increased by the increase of the thickness, the cost further increases.

A pressure-resistance and heat-transfer vessel using an inexpensive steel tube has been known, but the vessel is poor in thermal conductivity. In addition, in the spinning process, it is difficult to the drawing process as long as the temperature does not become a high temperature at which deformation resistance of a material decreases. Accordingly, it is necessary to perform sufficient preheating with a burner according to the shape, and to be 900° C. or 1000° C. or higher at the time of the processing with process heat. For this reason, a tool is overloaded and thus durability of the tool decreases. Such a steel tube is formed mainly by brazing or welding a press product, but reliability is low. Considering factor of safety, the weight of the pressure-resistance and heat-transfer vessel considerably increases.

In addition, there has been known a copper alloy tube containing Sn of 0.1 to 1.0 mass %, P of 0.005 to 0.1 mass %, 0 of 0.005 mass % or less, H of 0.0002 mass % or less, and the remainder including Cu and inevitable impurities, wherein an average crystal grain diameter is 30 μm or less (see Patent Document 1).

Since the copper alloy tube shown in Patent Document 1 is easily recrystallized at a high temperature, pressure resistance of the pressure-resistance and heat-transfer vessel processed at a high temperature after a spinning process or a brazing process is not sufficient.

Patent Document 1: Japanese Patent Application Laid-Open No. 2003-268467

SUMMARY OF THE INVENTION

The invention has been made to solve the aforementioned problems, and an object thereof is to provide a high strength and high thermal conductivity copper alloy tube having high pressure resistance substantially without decreasing strength even when performing a drawing process, and a method for producing the same.

To achieve the aforementioned object, there is provided a high function copper tube which is subjected to a drawing process and has an alloy composition containing: Co of 0.12 to 0.32 mass %; P of 0.042 to 0.095 mass %; and Sn of 0.005 to 0.30 mass %, wherein a relationship of $3.0 \leq ([Co]-0.007)/([P]-0.008) \leq 6.2$ is satisfied between a content [Co] mass % of Co and a content [P] mass % of P, and the remainder includes Cu and inevitable impurities.

According to the invention, even when a temperature is increased by heat generated by the drawing process, a compound of Co and P is uniformly precipitated and Sn is solid-dissolved. Accordingly, a recrystallization temperature increases, and generation of a recrystallization nucleus is delayed, thereby improving heat resistance and pressure resistance of the high function copper tube.

In addition, there is provided a high function copper tube which is subjected to a drawing process and has an alloy composition containing: Co of 0.12 to 0.32 mass %; P of 0.042 to 0.095 mass %; Sn of 0.005 to 0.30 mass %; and at least one of Ni of 0.01 to 0.15 mass % and Fe of 0.005 to 0.07 mass %, wherein relationships of $3.0 \leq ([Co]+0.85\times[Ni]+0.75\times[Fe]-0.007)/([P]-0.008) \leq 6.2$ and $0.015 \leq 1.5\times[Ni]+3\times[Fe] \leq [Co]$ are satisfied among a content [Co] mass % of Co, a content [Ni] mass % of Ni, a content [Fe] mass % of Fe, and a content [P] mass % of P, and the remainder includes Cu and inevitable impurities. Accordingly, precipitates of Co, P, and the like become fine by Ni and Fe, thereby improving heat resistance and pressure resistance of the high function copper tube.

Preferably, the alloy composition further contains at least one of Zn of 0.001 to 0.5 mass %, Mg of 0.001 to 0.2 mass %, and Zr of 0.001 to 0.1 mass %. Accordingly, S mixed in the course of recycle of the copper material is made unharmful by Zn, Mg, and Zr, intermediate temperature embrittlement is prevented, and the alloy is further strengthened, thereby improving ductility and strength of the high function copper tube.

Preferably, a recrystallization ratio of a metal structure of a drawing-processed portion subjected to the drawing process is 50% or less, or a recrystallization ratio of a heat-influenced portion is 20% or less. Accordingly, strength is high since the recrystallization ratio is low. More preferably, the recrystallization ratio of the heat-influenced portion is 10% or less.

Preferably, a value of Vickers hardness (HV) of a drawing-processed portion subjected to the drawing process after heating at 700° C. for 20 seconds is 90 or more, or is 80% or more of a value of Vickers hardness before the heating. Accordingly, strength is high even after connection by brazing with another tube. A recrystallization ratio of a metal structure of a part corresponding to the heat-influenced portion after the heating at 700° C. for 20 seconds may be 20% or less, and preferably, 10% or less. The condition of the heating at 700° C. for 20 seconds is a strict condition corresponding to a case where the heat-influenced portion of the pressure-resistance and heat-transfer vessel or a part corresponding to the heat-influenced portion is influenced by heat of the spinning process, or heat of the brazing and spinning processes.

Preferably, the drawing process is a spinning process, and a recrystallization ratio of a metal structure of a drawing-processed portion subjected to the spinning process is 50% or less. Accordingly, strength is high since the average of the recrystallization ratio is low. The recrystallization ratio is preferably 40% or less, and most preferably, 25% or less. In addition, the recrystallization ratio of the heat-influenced portion having a large diameter is 20% or less, and preferably, 10% or less. Since Co, P, and the like solid-dissolved by the heat of the spinning process are precipitated, softening caused by the recrystallization or restoration caused by the heat of the spinning process is offset. Accordingly, high strength is kept, and thermal conductivity is improved.

Preferably, the drawing process is a cold-drawing process, and a recrystallization ratio of a metal structure of the drawing-processed portion subjected to the cold-drawing process is 50% or less, or a recrystallization ratio of a heat-influenced portion is 20% or less, after brazing with another copper tube at the end portion thereof. Accordingly, strength is high since the recrystallization ratio is low.

Preferably, a value of $(P_B \times D/T)$ is 600 or more, where D (mm) is an outer diameter of a straight tube portion which is not subjected to the drawing process, T (mm) is a thickness, and $P_B$ (MPa) is a burst pressure that is a pressure at the time of bursting the straight tube portion by applying internal pressure. Accordingly, it is possible to decrease the thickness T of the pressure-resistance heat-transfer vessel since the value of $(P_B \times D/T)$ is large. Therefore, it is possible to produce the pressure-resistance and heat-transfer vessel with low cost. The value of $(P_B \times D/T)$ is preferably 700 or more, and most preferably, 800 or more.

Preferably, a value of $(P_{0.5\%} \times D/T)$ is 300 or more, where D (mm) is an outer diameter of a straight tube portion which is not subjected to the drawing process, T (mm) is a thickness, and $P_{0.5}$% (MPa) is a 0.5% deformation pressure that is a pressure at the time of deforming the outer diameter by 0.5% by applying internal pressure, or a value of $(P_{1\%} \times D/T)$ is 350 or more, where $P_{1\%}$ (MPa) is a 1% deformation pressure that is a pressure at the time of deforming the outer diameter by 1%. Accordingly, it is possible to decrease the thickness T of the pressure-resistance and heat-transfer vessel since the value of $(P_{0.5\%} \times D/T)$ or $(P_{1\%} \times D/T)$ is large. Therefore, it is possible to produce the pressure-resistance and heat-transfer vessel with low cost. The value of $(P_{0.5\%} \times D/T)$ is preferably 350 or more, and most preferably, 450 or more. The value of $(P_{1\%} \times D/T)$ is preferably 400 or more, and most preferably, 500 or more.

Preferably, in a metal structure of a process end portion and a process center portion before the drawing process, after the drawing process, or after brazing with another copper tube, substantially circular or substantially oval fine precipitates of 2 to 20 nm having Co and P are uniformly dispersed, or 90% or more of all precipitates are uniformly dispersed as fine precipitates having a size of 30 nm or less. Accordingly, since the fine precipitates are uniformly dispersed, heat resistance is excellent, pressure resistance is high, and thermal conductivity is good.

Preferably, a metal structure of a process center portion subjected to the drawing process is recrystallized, and has a crystal grain diameter of 3 to 35 μm. Accordingly, strength and pressure resistance are high since the recrystallization grain diameter is small.

Preferably, the high function copper tube is used as a pressure-resistance and heat-transfer vessel of a heat exchanger. Accordingly, the cost is reduced since the thickness of the pressure-resistance and heat-transfer vessel is small. In addition, the weight is reduced since the thickness of the pressure-resistance and heat-transfer vessel becomes small. Therefore, a member for holding the pressure-resistance and heat-transfer vessel is little, and thus the cost is reduced.

In addition, there is provided a method for producing the high strength and high thermal conductivity copper alloy tube, wherein the method includes hot extruding or hot tube rolling, a heating temperature before the hot extruding, a heating temperature before the hot tube rolling, or a maximum temperature at the time of the rolling is 770 to 970° C., a cooling rate from the temperature of the tube after the hot extruding or the hot tube rolling to 600° C. is 10 to 3000° C./second, and then cold tube rolling or drawing is performed at a process ratio of 70% or more, and thereafter, a drawing process is performed. Accordingly, the cold rolling or the cold drawing is performed at the process ratio of 70% or more, and thus the copper alloy tube has high strength by the work hardening. The temperature of the ingot, the temperature of the hot-rolling material, or the hot-extruding starting temperature is 770 to 970° C., and thus sensitivity of solution is insensitive. Accordingly, when the cooling rate from the temperature of the tube immediately after the hot extruding or hot tube rolling to 600° C. is 10 to 3000° C./second, Co, P, Ni, Fe, and the like are sufficiently solid-dissolved. In such a state, atoms such as Co start moving before recrystallization in spite of increase in temperature, Co and P, or Co, Ni, Fe, and P are coupled, thereby fine precipitates are precipitated. Accordingly, the recrystallization is delayed, thereby improving heat resistance. After the temperature increases to 800° C. or higher, growth of crystal grains is suppressed by the fine precipitates with Co, P, and the like even after the recrystallization. Therefore, the recrystallized grains are fine. As a result, the tube has high strength. In the present specification, "sensitivity of solution is insensitive" means that the high-temperature solid-dissolved atoms hardly precipitate even when the cooling rate is low during the cooling. The process ratio means (1−(cross-sectional area of tube after process)/(cross-section area of tube before process))×100%.

Preferably, the drawing process is a spinning process. Accordingly, in the process end portion of the spinning process and the heat-influenced portion adjacent to the process end portion, before the process, Sn is solid-dissolved, and a part of Co, P, and the like is precipitated but most of them are solid-dissolved. Therefore, even when the temperature is increased for several seconds by the spinning process, most of them are not softened or recrystallized and the strength of the materials is kept. When the temperature is increased to about 700 to 750° C. even for a short time, the precipitation of Co, P, and the like is progressed. Accordingly, precipitation hardening occurs. A restoration phenomenon of matrix is offset by the precipitation hardening, and a softening phenomenon is offset by partial recrystallization, thereby keeping the strength. In addition, thermal conductivity is improved by precipitating Co, P, and the like. The temperature of a part subjected to the spinning process, particularly, the process center portion is increased to 800° C. or higher by process heat, and thus the process center portion is recrystallized. This suggests the recrystallization state in the course of the spinning process, and hot deformation resistance is low at the time of the process. Therefore, it is easy to perform the spinning process. At the part subjected to the spinning process, the growth of recrystallized grains is suppressed by the precipitates of Co, P and the like. Accordingly, the diameter thereof is small, and the strength is very high as compared with the case using phosphorus deoxidized copper C1220. In the spinning process, for example, there is a method of spinning a tube in a high speed for drawing. Naturally, all the methods are included herein.

Preferably, the drawing process is a cold-drawing process, and a cold processing ratio obtained by combining with a cold process in the cold tube rolling and the drawing is 70% or more. Accordingly, the drawing process is performed by the cold process, and thus the strength is high due to the process hardening and the pressure resistance is high. Even when brazing is performed by connecting to another tube, the recrystallization temperature of the copper tube subjected to the drawing process is increased by the solid solution of Sn and the solid solution of Co, P, and the like. At the time of the brazing, at a part heated to about 700° C. by the heat influence, the softening of matrix and the precipitation hardening by Co, P, and the like are offset, thereby keeping high strength. At a part subjected to the brazing, the growth of recrystallized grains is suppressed by the precipitated precipitates even in the case of recrystallization, thereby keeping high strength.

Preferably, the high function copper tube is subjected to a brazing process or a welding process. Accordingly, even when the temperature is increased by the brazing process or the welding process, the recrystallization is delayed by the precipitates of Co, P, and the like. Therefore the strength is high. In this case, even when softening occurs by partial recrystallization, the strength is kept by the precipitation hardening of Co, P, and the like. In addition, thermal conductivity is improved by precipitating the precipitates.

Preferably, a heat treatment at 350 to 600° C. for 10 to 300 minutes is performed before the drawing process or after the drawing process. The precipitation hardening occurs by the heat influence at the time of the spinning process, but Co, P, and the like are further precipitated by actively (at 350 to 600° C., for 10 to 300 minutes) performing the heat treatment. Therefore, the strength and thermal conductivity are improved.

BRIEF DESCRIPTION OF THE DRAWINGS

FIG. 3A is a metal structure photograph of the process center portion of the pressure-resistance and heat-transfer vessel, FIG. 3B is a metal structure photograph of a process end portion, FIG. 3C is a metal structure photograph of a heat-influenced portion, FIG. 3D is a metal structure photograph of a straight tube portion, FIG. 3E is a metal structure photograph of the known pressure-resistance and heat-transfer vessel, FIG. 3F is a metal structure photograph of a process end portion, FIG. 3G is a metal structure photograph of a heat-influenced portion, and FIG. 3H is a metal structure photograph of a straight tube portion.

BEST MODE FOR CARRYING OUT THE INVENTION (DETAILED DESCRIPTION OF INVENTION)

First Embodiment

Figure 1:
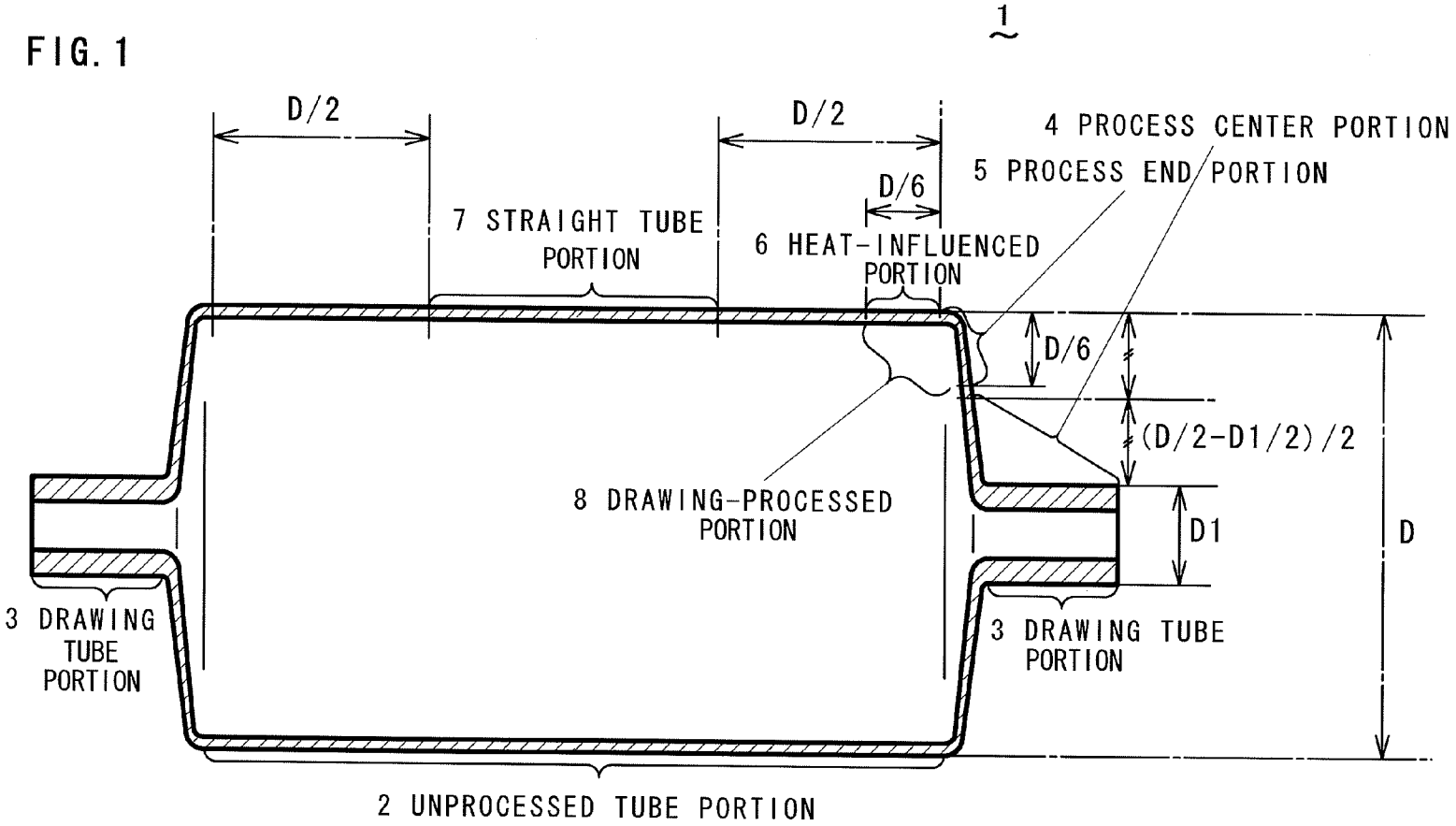
FIG. 1 is a side sectional view illustrating a pressure-resistance and heat-transfer vessel.

A high function copper tube according to a first embodiment of the invention will be described. In the invention, alloys (hereinafter, referred to as first invention alloy, second invention alloy, third invention alloy, and fourth invention alloy) having alloy compositions of the high function copper tubes according to first to fourth embodiments are provided. In the alloy compositions described in the specification, a symbol for element in parenthesis such as [Co] represents a content of the element. Invention alloy is the general term for the first to fourth invention alloys.

The first invention alloy contains Co of 0.12 to 0.32 mass % (preferably 0.13 to 0.28 mass %, more preferably 0.15 to 0.24 mass %), P of 0.042 to 0.095 mass % (preferably 0.046 to 0.079 mass %, more preferably 0.049 to 0.072 mass %), and Sn of 0.005 to 0.30 mass % (preferably 0.01 to 0.2 mass %, more preferably 0.03 to 0.16 mass %, or particularly, in the case of needing high thermal conductivity, 0.01 to 0.045 mass %), in which a relationship of X1=([Co]−0.007)/([P]−0.008) is satisfied between a content [Co] mass % of Co and a content [P] mass % of P, X1 is 3.0 to 6.2, preferably 3.2 to 5.7, more preferably 3.4 to 5.1, and most preferably 3.5 to 4.6, and the remainder includes Cu and inevitable impurities.

The second invention alloy has the same composition ranges of Co, P, and Sn as those of the first invention alloy, and further contains at least one of Ni of 0.01 to 0.15 mass % (preferably 0.02 to 0.12 mass %, and more preferably 0.025 to 0.09 mass %) and/or Fe of 0.005 to 0.07 mass % (preferably 0.008 to 0.05 mass %, and more preferably 0.015 to 0.035 mass %), in which a relationship of X2=([Co]+0.85×[Ni]+0.75×[Fe]−0.007)/([P]−0.008) is satisfied among a content [Co] mass % of Co, a content [Ni] mass % of Ni, a content [Fe] mass % of Fe, and a content [P] mass % of P, X2 is 3.0 to 6.2, preferably 3.2 to 5.7, more preferably 3.4 to 5.1, and most preferably 3.5 to 4.6, a relationship of X3=1.5×[Ni]+3×[Fe] is satisfied, X3 is 0.015 to [Co], preferably 0.035 to (0.9×[Co]), and more preferably 0.05 to (0.8×[Co]), and the remainder includes Cu and inevitable impurities.

The third invention alloy further contains, in addition to the alloy composition of the first invention alloy, at least one of Zn of 0.001 to 0.5 mass %, Mg of 0.001 to 0.2 mass %, and Zr of 0.001 to 0.1 mass %.

The fourth invention alloy further contains, in addition to the alloy composition of the second invention alloy, at least one of Zn of 0.001 to 0.5 mass %, Mg of 0.001 to 0.2 mass %, and Zr of 0.001 to 0.1 mass %.

Next, the reason of adding each element will be described. High strength and heat resistance cannot be obtained by independent addition of Co. However, when Co is added together with P and Sn, it is possible to obtain high strength and heat resistance without decreasing thermal and electrical conductivity. The independent addition of Co slightly increases the strength, and does not cause a significant effect. Above the upper limit (0.32 mass %) of the Co content, the aforementioned effect is saturated, high-temperature deformation resistance increases, drawing-process workability decreases in the spinning process, and thermal and electrical conductivity decreases. Below the lower limit (0.12 mass %) of the Co content, the effect of increasing strength and heat resistance cannot be obtained even when Co is added together with P and Sn.

When P is added together with Co and Sn, it is possible to obtain high strength and heat resistance without decreasing thermal and electrical conductivity. The independent addition of P improves molten metal fluidity and strength, and refines crystal grains. Above the upper limit (0.095 mass %) of the P content, the aforementioned effect is saturated, and thermal and electrical conductivity starts deteriorating. In addition, cracks easily occur at the time of casting or hot rolling, and bending workability deteriorates. Below the lower limit (0.042 mass %) of the P content, the effect of strength and heat resistance cannot be obtained.

Under the presupposition of satisfying the aforementioned relational expression of Co and P, the effect of improving heat resistance and pressure resistance start being improved in Co: 0.12 mass % or more and P: 0.042 mass % or more. As the content increases, these effects are improved. Preferably, Co is 0.13 mass % or more and P is 0.046 mass % or more, and more preferably Co is 0.15 mass % or more and P is 0.049 mass % or more. When Co is added by more than 0.32 mass % and P is added by more than 0.095 mass %, the aforementioned effects are saturated and also hot deformation resistance increases. Moreover, a problem in an extruding or spinning process occurs, and thus ductility starts decreasing. Accordingly, preferably, Co is 0.28 mass % or less and P is 0.079 mass % or less, and more preferably Co is 0.24 mass % or less and P is 0.072 mass % or less.

Only with precipitates mainly based on Co and P, heat resistance of matrix is insufficient. However, the heat resistance of matrix is improved by adding Sn, and particularly, a softening temperature or recrystallization temperature of matrix is increased by the adding of Sn. In addition, strength, elongation, and bending workability are improved. Recrystallized grains generated at the time of the hot process such as the spinning process are made fine, and sensitivity of solution of Co, P, and the like is made insensitive. In addition, there is an effect of finely and uniformly dispersing the precipitates based on Co and P. Above the upper limit (0.30 mass %) of the Sn content, thermal and electrical conductivity decreases and hot deformation resistance increases, and thus the processes such as the hot tube extruding or drawing are difficult. Preferably, Sn is 0.2 mass % or less, more preferably 0.16 mass % or less, and further more preferably 0.095 mass % or less. Particularly, in the case of needing high thermal conductivity, Sn is preferably 0.045 mass % or less. Below the lower limit (0.005 mass %) of the Sn content, heat resistance of matrix decreases.

To obtain high thermal and electrical conductivity in addition to high pressure resistance and heat resistance, a combination ratio of Co, Ni, Fe, and P is very important. The precipitates generated by combining Co, Ni, Fe, and P, for example, substantially circular or substantially oval fine precipitates having an average grain diameter of 2 to 20 nm such as $Co_xP_y$, $Co_xNi_yP_z$, and $Co_xFe_yP_z$ are uniformly dispersed, or the precipitates are uniformly dispersed as fine precipitates in which 90% or more of all precipitates has a size of 30 nm or less. Accordingly, the growth of crystal grains is suppressed by the precipitates even when heating at 800° C., and thus high strength can be obtained. Alternatively, high strength can be obtained by the precipitation hardening. Further, even in the case where these elements are in a solid-dissolved state, the precipitates thereof are finely dispersed and precipitated during a high-temperature process or during connection with another tube by brazing, for a short time. Accordingly, the recrystallization is delayed and the recrystallization temperature increases, thereby improving heat resistance. When the high function copper tube of the invention is heated to a temperature of 800° C. or higher in the course of the drawing process or the like, matrix is recrystallized. However, the growth of the recrystallized grains is suppressed by the precipitates of Co, P, and the like, and thus the recrystallized grains stands in the fine state. When the temperature is increased from 600° C. to 700° C., the strength of the high function copper tube of the invention subjected to the cold process in the procedure for producing an unprocessed tube and the procedure for producing a drawing copper tube is high by the precipitation hardening by the fine precipitates of Co, P, and the like, and the solid solution hardening. The aforementioned average diameter is a length measured in the observation plane that is a two-dimensional plane. The precipitates in the specification exclude materials created in the casting step.

The contents of Co, P, Fe, and Ni should satisfy the following relationship. X1=([Co]−0.007)/([P]−0.008) is satisfied among the content [Co] mass % of Co, the content [Ni] mass % of Ni, the content [Fe] mass % of Fe, and the content [P] mass % of P, in which X1 is 3.0 to 6.2, preferably 3.2 to 5.7, more preferably 3.4 to 5.1, and most preferably 3.5 to 4.6. When X1 is larger than 6.2, thermal conductivity deteriorates and pressure resistance and heat resistance also deteriorate. When X1 is 3.0 or less, particularly ductility deteriorates and thus cracks easily occur at the time of casting or hot processing. In addition, hot deformation resistance increases, and pressure resistance, heat resistance, and thermal conductivity deteriorate. In the case of adding Ni and Fe, X2=([Co]+0.85×[Ni]+0.75×[Fe]−0.007)/([P]−0.008) is satisfied, in which X2 is 3.0 to 6.2, preferably 3.2 to 5.7, more preferably 3.4 to 5.1, and most preferably 3.5 to 4.6. When X2 is larger than 6.2, heat resistance is insufficient and a recrystallization temperature decreases. Accordingly, the growth of crystal grains cannot be suppressed at the time of increasing the temperature. For this reason, pressure resistance after the drawing process is not obtained, and thermal and electrical conductivity decreases. When X2 is 3.0 or less, thermal and electrical conductivity decreases, and ductility deteriorates. In addition, pressure resistance decreases.

Even when the combination ratios of elements such as Co are the same as the constituent ratios in the compound, all are not combined. In the aforementioned expression, ([Co]−0.007) means that Co remains in a solid-solution state by 0.007 mass %, and ([P]−0.008) means that P remains in a solid-solution state by 0.008 mass % in matrix. When a mass ratio of Co and P participating in the combination of the precipitates is about 4:1 or about 3.5:1, the combination state of the precipitates is preferable. The precipitates are represented by, for example, $Co_2P$, $CO_{2.a}P$, $Co_xP_y$. However, the combination state or solid-solution state thereof is changed by process conditions such as a temperature and a process ratio. In consideration of these, a limitation range of the expression X1 is set. When X1 is out of the limitation range, Co and P do not participate in the compound and are in the solid-solution state or become precipitates in a state different from the combination state of desired $Co_2P$, $Co_{2.a}P$, or the like. Accordingly, high strength, satisfactory thermal conductivity, or excellent heat resistance cannot be obtained.

Independent addition of elements of Fe and Ni hardly contribute to improvement of properties such as heat resistance and strength, and deteriorates electrical conductivity. A part of the function of Co is replaced by Fe and Ni in the group in which Co and P are added together. In the aforementioned expression ([Co]+0.85×[Ni]+0.75×[Fe]−0.007), a coefficient 0.85 of [Ni] and a coefficient 0.75 of [Fe] represent a ratio of Ni or Fe coupled with P when the coupling of Co and P is set to 1. When a ratio of [P] and ([Co]+0.85×[Ni]+0.75×[Fe]) participating in the coupling of the precipitates is about 4:1 or about 3.5:1, the combination state of the precipitates is preferable. The precipitates is represented by $Co_xNi_yp_z$, $Co_xFe_yP_z$, and the like partially substituted by Ni and Fe instead of Co in the $Co_2P$, $Co_{2.a}P$, and $Co_xP_y$. However, the combination state or solid-solution state is changed by the process conditions such as a temperature and a process ratio. In consideration of theses, a limitation range of X2 is set similarly with the expression X1. When X2 is out of the limitation range, Co, Ni, Fe, and P do not participate in the compound and are in the solid-solution state or become precipitates in a state different from the combination state of desired $Co_2P$ and $Co_{2.a}P$. Therefore, high strength, satisfactory thermal conductivity, or excellent heat resistance cannot be obtained.

On the other hand, when other elements are added to copper, conductivity deteriorates. In addition, thermal conductivity and electrical conductivity are changed substantially at the same ratio. For example, generally, when Co, Fe, and P are independently added to pure copper by 0.02 mass %, thermal and electrical conductivity decreases by about 10%. When Ni is independently added by 0.02 mass %, thermal and electrical conductivity decreases by about 1.5%. When the content of each element such as Co is apart from an appropriate ratio and is in a solid-solution state, thermal and electrical conductivity clearly decreases.

Even when Ni is in the solid-solution state as described above, influence on thermal conductivity is small as compared with the solid-solution state of Co or P. The coupling strength of Ni with P is weaker than the coupling strength of Fe or Co with P. Accordingly, a value of the aforementioned expression ([Co]+0.85×[Ni]+0.75×[Fe]−0.007)/([P]−0.008) deviates from the middle of 3.0 to 6.2 to the large side thereof, Fe and Co are firstly coupled with P and then Ni is solid-dissolved. Therefore, deterioration of electrical conductivity is suppressed to the minimum. However, when Ni is added excessively (amount of 0.15 mass % or more, or more than the expression (1.5×[Ni]+3×[Fe]≤[Co])), the composition of the precipitates is gradually changed, thereby deteriorating pressure resistance and heat resistance and decreasing thermal conductivity.

When Fe is added together with Co and P, pressure resistance and heat resistance are improved by the small amount of Fe. However, when Fe is added excessively (0.07 mass % or more, or amount exceeding the expression (1.5×[Ni]+3×[Fe]≤[Co])), the composition of the precipitates is gradually changed, thereby deteriorating pressure resistance and heat resistance as well as decreasing thermal conductivity. In the metal structure after the drawing process or the metal structure after connecting the copper tube subjected to the drawing process to another copper tube, substantially circular or substantially oval fine precipitates of 2 to 20 nm, that is, an average grain diameter of 2 to 20 nm having Co and P are uniformly dispersed, or 90% or more of all precipitates are uniformly dispersed as fine precipitates having a size of 30 nm or less. Accordingly, the high function copper tube of the invention has high pressure resistance.

Zn, Mg, and Zr render S mixed in the course of recycle of Cu unharmful, decrease intermediate temperature embrittlement, and improve ductility and heat resistance. In addition, Zn, Mg, and Zr have effects of strengthening the alloy and promoting uniform precipitation of Co and P. Zn also improves solder ettability and a brazing property. Zn has the aforementioned effects, but in product producing environment or using environment, for example, at a high temperature of 200° C. or more, in the case of producing or using under vacuum or under inert gas, Zn is vaporized in the atmosphere and is deposited to a device or the like, and thus a problem may occur. In such a case, in the first to fourth invention alloys, Zn should be set less than 0.05 mass %.

Next, a process of producing the high function copper tube made by hot extrusion will be described. The invention is applied to another unprocessed tube producing method, that is, a method in which an unprocessed tube is obtained from a continuous cast having a cylindrical shape using heat generated by the annealing process, in a hot rolling state, or in the Mannesmann method, thereby obtaining a tube member having the size obtained in a cold state as described above. An ingot having the aforementioned composition is heated to 770 to 970° C., and then a hot extruding process is performed thereon. The heating temperature of the ingot is preferably 800 to 970° C., and more preferably 850 to 960° C. The lower limit temperature is necessary for destroying the structure of the ingot, for making the structure into a hot-processed structure, for decreasing deformation resistance at the time of the extruding, and for making Co and P into a solid-solution state. To further improve the effects, the lower limit temperature is preferably 800° C. or higher, and more preferably 850° C. or higher. When the lower limit temperature is higher than 970°

C., crystal grains of the extruded unprocessed tube become coarsened by active recrystallization at the time of the hot extruding or passive recrystallization immediately after the process. The solid-solution state of Co and P is saturated, and thus energy used for heating is wasted.

Considering the connection by the spinning process or brazing with another tube, it seems to be contradictory to the problem to be solved of the invention, but it is preferable that thermal conductivity of the copper tube before the process be poor. The reason is, in the case of the spinning process, deformation resistance is low when process heat is not thermally diffused and high temperature is kept in the process center portion 4 having large deformation, and it is possible to easily perform larger deformation. Since the strength of the heat-influenced portion 6 or process end portion 5 having a large diameter has an effect on pressure resistance, it is preferable that heat diffusion into these parts be little. When thermal conductivity is good in the brazing at the time of connection, the whole drawing-processed portion 8 is heated. Accordingly, the temperature of the process end portion 5 or the heat-influenced portion 6 increases. Depending on the shape of the pressure-resistance and heat-transfer vessel, in conductivity having a positive relationship with thermal conductivity, conductivity of the copper tube before the process is preferably 60% IACS or less.

A cooling rate up to 600° C. after the extruding is set in the range of 10 to 3000° C./second. With Co and the like solid-dissolved, that is, when Co and the like are hardly precipitated, a cold process such as drawing after the hot extruding is easy. Accordingly, it is preferable that the cooling rate be high. However, in the case of the alloy of the invention, for example, even in 30° C./second that is a cooling rate in compulsory air cooling, Co and the like are hardly precipitated in the cooling process. Therefore, a preferable cooling rate is 30° C./second to 3000° C./second.

Cold rolling or drawing is repeated after the hot extruding, thereby producing an unprocessed tube. A process ratio of the cold process is 70% or more. When the process ratio is 70% or more, it is possible to obtain tensile strength of about 450 $N/mm^2$ or more by the process hardening. This strength is higher than that of the known phosphorus deoxidized copper C1220 by about 30%. A spinning process is performed on the unprocessed tube obtained by the drawing and the like, thereby producing a pressure-resistance and heat-transfer vessel. The spinning process is changed according to an outer diameter, a thickness, or the like of the unprocessed tube, and is performed for several seconds or ten several seconds. To improve precision of the shape, the front end of the tube is pressed by dies or a roller for about 10 seconds after the spinning process. Although the pressure-resistance and heat-transfer vessel obtained as described above may be used as it is, a heat treatment may be performed thereon at 350 to 600° C. for 10 to 300 minutes after the spinning process. This heat treatment preferably satisfies $6.4 \leq T/80+\log t \leq 8.4$, and most preferably satisfies $6.5 \leq T/80+\log t \leq 8.0$, where time is t (minutes) and temperature is T (° C.) in a relationship of time and temperature. The purpose of the heat treatment is to improve strength and ductility, particularly thermal conductivity, by precipitating Co, P, and the like solid-dissolved in matrix. When the temperature or the time is insufficient, Co, P, and the like are not precipitated and thus there is no effect. When the temperature or the time is excessive, the alloy is recrystallized and thus the strength decreases. Preferably, the heat treatment is performed after the spinning process, but it is still effective even when performed before the spinning process.

As a method for producing the pressure-resistance and heat-transfer vessel, a spinning process may be performed using a welded tube obtained by bending a rolled plate in a cylindrical shape and welded to without performing the hot extruding, tube rolling, and drawing described above. This rolled plate may be made of a rolled hard material, and made of a soft material subjected to a heat treatment, in which strength capable of performing the spinning process is necessary. Similarly with the case of using the extruding tube, it is possible to obtain the pressure-resistance and heat-transfer vessel having high pressure resistance. In addition, before the spinning process or after the spinning process, a heat treatment may be performed at 350 to 600° C. for 10 to 300 minutes, thereby improving the pressure resistance and thermal conductivity.

Example

High function copper tubes were produced using the above-described first invention alloy, second invention alloy, third invention alloy, fourth invention alloy, and copper having the comparative composition, and the drawing process is performed on the high function copper tubes, thereby producing pressure-resistance and heat-transfer vessels. Table 1 shows compositions of the alloys for producing the pressure-resistance and heat-transfer vessels.

TABLE 1

| | Alloy Composition (mass %) | | | | | | | | | | | | |
|---|---|---|---|---|---|---|---|---|---|---|---|---|---|
| | Alloy No. | Cu | P | Co | Sn | Ni | Fe | Zn | Mg | Zr | X1 | X2 | X3 |
| First Inv. Alloy | 1 | Rem. | 0.058 | 0.2 | 0.08 | | | | | | 3.86 | | |
| | 2 | Rem. | 0.049 | 0.16 | 0.03 | | | | | | 3.73 | | |
| | 3 | Rem. | 0.071 | 0.25 | 0.09 | | | | | | 3.86 | | |
| Second Inv. Alloy | 4 | Rem. | 0.057 | 0.19 | 0.08 | 0.04 | | | | | | 4.43 | 0.06 |
| | 5 | Rem. | 0.052 | 0.17 | 0.17 | 0.03 | | | | | | 4.28 | 0.05 |
| | 6 | Rem. | 0.049 | 0.14 | 0.05 | | 0.025 | | | | | 3.70 | 0.08 |
| Third Inv. Alloy | 7 | Rem. | 0.08 | 0.27 | 0.009 | | | 0.05 | | | 3.65 | | |
| Fourth Inv. Alloy | 8 | Rem. | 0.055 | 0.19 | 0.07 | 0.02 | | 0.23 | | | | 4.26 | 0.03 |
| | 9 | Rem. | 0.052 | 0.17 | 0.13 | 0.035 | | 0.03 | | | | 4.38 | 0.05 |
| | 10 | Rem. | 0.061 | 0.21 | 0.09 | 0.02 | | 0.04 | | | | 4.15 | 0.03 |
| | 11 | Rem. | 0.085 | 0.26 | 0.03 | 0.05 | | | 0.08 | | | 3.84 | 0.08 |
| | 12 | Rem. | 0.056 | 0.18 | 0.1 | | 0.03 | 0.1 | | | | 4.07 | 0.09 |
| | 13 | Rem. | 0.06 | 0.2 | 0.04 | 0.03 | | | | 0.05 | | 4.20 | 0.05 |
| Third Inv. Alloy | 14 | Rem. | 0.07 | 0.24 | 0.08 | | | 0.04 | 0.03 | | 3.76 | | |

TABLE 1-continued

| | Alloy No. | Alloy Composition (mass %) | | | | | | | | | | | |
|---|---|---|---|---|---|---|---|---|---|---|---|---|---|
| | | Cu | P | Co | Sn | Ni | Fe | Zn | Mg | Zr | X1 | X2 | X3 |
| Fourth Inv. Alloy | 15 | Rem. | 0.065 | 0.25 | 0.07 | 0.05 | | 0.11 | | | | 5.01 | 0.08 |
| Third Inv. Alloy | 16 | Rem. | 0.059 | 0.22 | 0.11 | | | 0.08 | | | 4.18 | | |
| Comp. Alloy | 21 | Rem. | 0.031 | | 0.22 | | | | | | | | |
| | 22 | Rem. | 0.03 | 0.17 | 0.11 | 0.015 | | 0.02 | | | | 7.99 | 0.02 |
| | 23 | Rem. | 0.033 | 0.14 | | | | | | | 5.32 | | |
| | 24 | Rem. | 0.023 | 0.22 | 0.04 | 0.03 | | | | | | 15.90 | 0.05 |
| | 25 | Rem. | 0.031 | 0.1 | 0.03 | | | | | | 4.04 | | |
| | 26 | Rem. | 0.043 | 0.12 | 0.02 | 0.06 | 0.07 | 0.05 | | | | 6.19 | 0.30 |
| | 27 | Rem. | 0.043 | 0.31 | 0.01 | | | 0.1 | 0.04 | | 8.66 | | |
| | 28 | Rem. | 0.13 | 0.29 | 0.16 | | | | | | 2.32 | | |
| | 29 | Rem. | 0.088 | 0.33 | 0.49 | | | | | | 4.04 | | |
| Comp. | 31 | Rem. | 0.024 | | | | | | | | | | |
| C1220 | 32 | Rem. | 0.026 | | | | | | | | | | |

X1 = ([Co] − 0.007)/([P] − 0.008)
X2 = ([Co] + 0.85[Ni] + 0.75[Fe] − 0.007)/([P] − 0.008)
X3 = 1.5[Ni] + 3[Fe]

The alloys are alloy No. 1 to 3 that are the first invention alloy, No. 4 to 6 that are the second invention alloy, alloy No. 7, 14, and 16 that are the third invention alloy, alloy No. 8 to 13 and 15 that are the fourth invention alloy, alloy No. 21 to 29 that have a compositions similar with the invention alloys for comparison, and alloy No 31 and 32 of C1220 that is the known phosphorus deoxidized copper. Pressure-resistance and heat-transfer vessels were produced from optional alloy by a plurality of process patterns.

Figure 2:
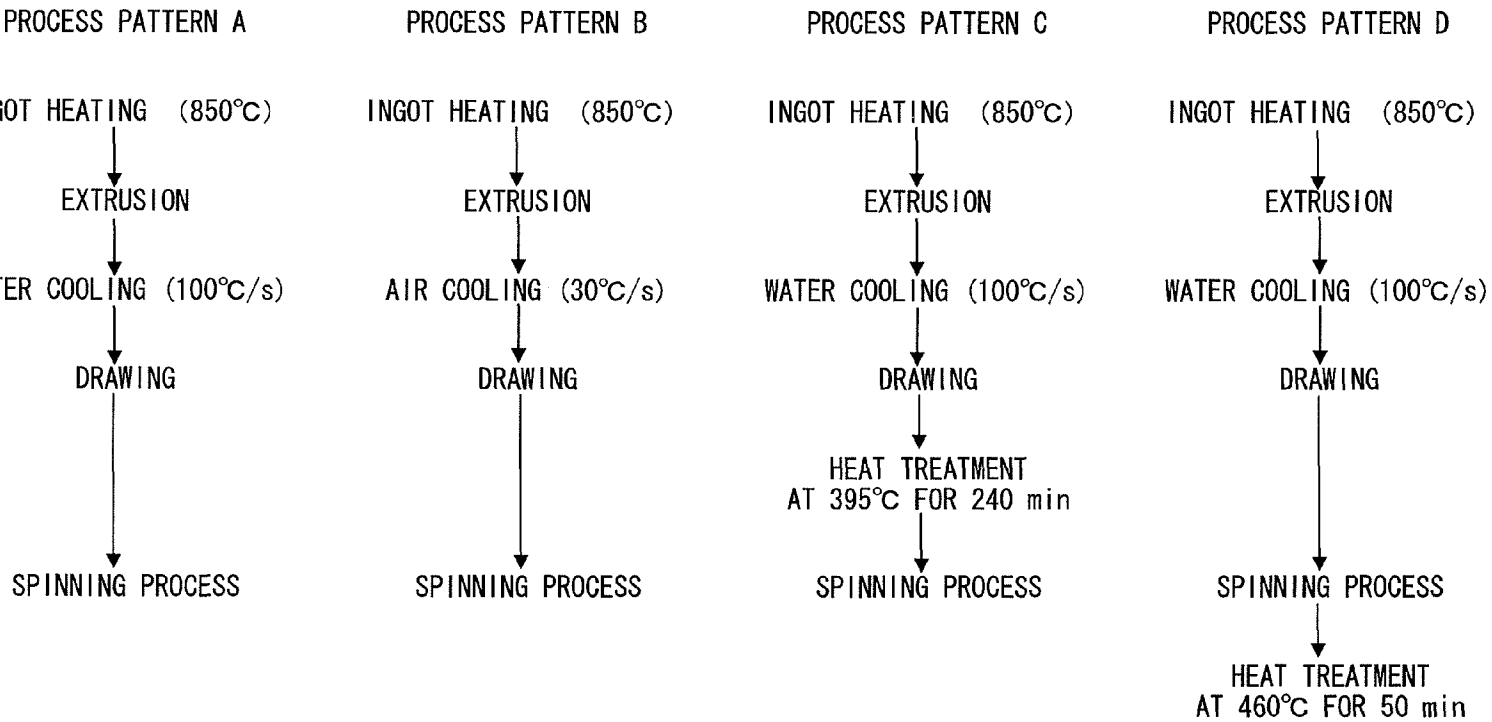
FIG. 2 is a flowchart for producing the pressure-resistance and heat-transfer vessel according to a first embodiment of the invention.

FIG. 2 shows processes for producing the pressure-resistance and heat-transfer vessel. In a process pattern A, first of all, an ingot of ϕ220 mm was heated to 850° C., and a tube having an outer diameter of 65 mm and a thickness of 6 mm was extruded into water. At that time, a cooling rate from a temperature of the tube immediately after the hot extruding to 600° C. was about 100° C./second. Subsequently, drawing after extruding was repeated to produce an unprocessed tube. The size of the unprocessed tube was basically an outer diameter of 50 mm and a thickness of 1 mm, and an outer diameter of 30 mm and a thickness of 1 mm. As for some alloys, unprocessed tubes having thicknesses of 1.5 mm, 0.7 mm, and 0.5 mm in for the outer diameter of 50 mm, and unprocessed tubes having thicknesses of 1.25 mm, 0.6 mm, and 0.4 mm for the outer diameter of 30 mm were produced. After the drawing, the unprocessed tubes were cut by a length of 250 mm or 200 mm, and both ends were drawn by a spinning process. In the case of the unprocessed tube having the outer diameter of 50 mm, a spinning condition was 1200 rpm and an average conveying rate of 15 mm/second. In the case of the unprocessed tube having the outer diameter of 30 mm, a spinning condition was 1400 rpm and an average conveying rate of 35 mm/second.

In a process pattern B, cooling after the extruding of the process pattern A was air cooling, and a cooling rate up to 600° C. was about 30° C./second. In a process pattern C, a heat treatment was performed at 395° C. for 240 minutes before the spinning process of the process pattern A. In a process pattern D, a heat treatment was performed at 460° C. for 50 minutes after the spinning process of the process pattern A. The process pattern A was a basic pattern, and pressure-resistance and heat-transfer vessels were produced from optional alloy according to the process patterns B to D. Conditions of the heat treatments of the process pattern C and the process pattern D are the heat treatment conditions of 350 to 600° C. and 10 to 300 minutes for precipitating Co, P, and the like described in the Summary of the Invention, last paragraph, and Detailed Description of the Preferred Embodiments, disclosure related to cooling rates.

Pressure resistance, Vickers hardness, and conductivity were measured as assessments of the pressure-resistance and heat-transfer vessels produced in the above-described method. In addition, a recrystallization ratio, a crystal grain diameter, a diameter of precipitates, and a ratio of precipitates having a size of 30 nm or less were measured by observing metal structure. Formability and deformation resistance in the course of the spinning process were assessed from workability of the spinning process. Two pressure-resistance and heat-transfer vessels were prepared for each producing condition. Pressure resistance of one vessel was measured, in which one end of the drawing tube portion 3 described above was connected to a jig made of brass for a pressure-resistance test by copper phosphorus brazing filler metal, and the other end was sealed up by copper brazing. The other vessel was not subjected to brazing, and the aforesaid properties such as metal structure, Vickers hardness, and conductivity were measured for the pressure-resistance and heat-transfer vessel as it was. A part of the process end portion 5 and the heat-influenced portion 6 were cut, immersed in a salt bath heated to 700° C., for 20 seconds, and taken out, and then air cooling was performed thereon. Vickers hardness and recrystallization ratio were measured. Heat resistance was assessed from the Vickers hardness and recrystallization ratio after the heating at 700° C. for 20 seconds, and the pressure resistance.

With respect to pressure resistance, the pressure-resistance pressure was measured, in which one end of the pressure-resistance and heat-transfer vessel was connected to a jig made of brass for a pressure-resistance test by copper phosphorus brazing filler metal, the other end was sealed up by copper phosphorus brazing filler metal, and water pressure was applied thereto. At the time of the brazing, first, the whole one end of the pressure-resistance and heat-transfer vessel was preheated by a burner, and then a connection portion (process center portion) of the pressure-resistance and heat-transfer vessel was heated to about 800° C. for several seconds (for 7 or 8 seconds) by a burner. In a pressure-resistance test, internal pressure was gradually raised by using tap water to reach burst, while carrying out a water pressure test by measuring the outer diameter for about every 1 MPa. At the time of measuring the outer diameter, the water pressure was returned to normal pressure so that there was no influence of swelling by elastic deformation. In the measuring of the pressure-resistance, the pressure-resistance and heat-transfer vessel was subjected to brazing with a jig of a tester. Accordingly, the assessment was performed in a state where the pressure-resistance and heat-transfer vessel was actually used by brazing with another copper tube.

In the pressure vessel to which internal pressure is applied, a relationship between a permissible pressure P and an outer diameter D, a thickness T, and a permissible tensile stress σ is $P=2\sigma/(D/T-0.8)$ pursuant to JIS B 8240 (Construction of Pressure Vessels for Refrigeration). When D is larger than T, the relationship may be approximately $P=2\sigma T/D$. Also in the pressure-resistance and heat-transfer vessel, generally, a pressure-resistance pressure P is represented by $P=a\times T/D$, and a proportional coefficient a is determined according to a material. As the proportional coefficient a gets larger, the pressure-resistance pressure gets larger. In this case, because of $a=P\times D/T$, a pressure in which the pressure-resistance and heat-transfer vessel is burst is represented by a burst pressure $P_B$. In the specification, a burst pressure index $PI_B$ as a material strength in which the pressure-resistance and heat-transfer vessel is burst is defined as follows.

$$PI_B=P_B\times D/T$$

Strength of a material of the pressure-resistance and heat-transfer vessel against the burst is assessed by the $PI_B$.

The pressure-resistance and heat-transfer vessel causes weariness destruction due to repeated deformation caused by little internal pressure or corrosion caused by appearance of a newly generated surface, even when the pressure-resistance and heat-transfer vessel is not burst by the internal pressure. Accordingly, it is a problem related to function and safety. For this reason, a pressure at the time when the pressure-resistance and heat-transfer vessel was slightly deformed by internal pressure was assessed. In the specification, an internal pressure at the time when the outer diameter of the pressure-resistance and heat-transfer vessel is increased by 0.5% by the pressure is defined as $P_{0.5\%}$, and a 0.5% deformation pressure index $PI_{0.5\%}$ as a material strength for starting deforming the pressure-resistance and heat-transfer vessel is determined as follows.

$$PI_{0.5\%}=P_{0.5\%}\times D/T$$

In the same manner as $N_{0.5\%}$, an internal pressure at the time when the outer diameter of the pressure-resistance and heat-transfer vessel is increased by 1% is defined as $P_{1\%}$, and a 1% deformation pressure index $PI_{1\%}$ is determined as follows.

$$PI_{1\%}=P_{1\%}\times D/T$$

Strength of a material of the pressure-resistance and heat-transfer vessel against initial deformation is assessed by $PI_{0.5\%}$ and $PI_{1\%}$.

In the measurement of the Vickers hardness, strength of the process center portion 4, the process end portion 5, the heat-influenced portion 6, and the straight tube portion 7 were measured. Small pieces cut from the process end portion 5 and the heat-influenced portion 6 were immersed in the salt bath heated to 700° C., for 20 seconds as described above, and the hardness and recrystallization ratio after the heating were measured.

The measurement of the recrystallization ratio was performed as follows. Non-recrystallized grains and recrystallized grains were classified from a structural photograph of a metal microscope of 100 magnifications, and a ratio occupied by the recrystallized part was set as the recrystallization ratio. That is, a state having flow of metal structure in a drawing direction of the tube was set as the non-recrystallized part, and clear recrystallized grains including macles were set as the recrystallized part. When the discrimination between the non-recrystallized part and the recrystallized part was unclear, in a part of samples, a region where a length in a drawing direction was three or more times of a length perpendicular to the drawing direction in a region surrounded by a grain system having a direction difference of 15 degrees or more from a crystal grain map by EBSP (Electron Backscatter Diffraction Pattern) of 200 magnifications was set as the non-recrystallized region, and an area ratio of the region was measured by image analysis (binarized by image processing software "WinROOF"). The obtained value was set as the non-recrystallization ratio, where recrystallization ratio=(1−non-recrystallization ratio). The EBSP was created by a device of FE-SEM (Field Emission Scanning Electron Microscope, Product No. JSM-7000F FE-SEM) of Japan Electronics Inc. provided with OIM (Orientation Imaging Microcopy, Crystal Orientation analyzer, Product No. TSL-OIM 5.1) of TSL Solutions Inc.

The crystal grain diameter was measured from a metal microscope photograph according to a comparison method of Methods for Estimating Average Grain Size of Wrought Copper and Copper-Alloys in JIS H 0501.

For the grain diameter of the precipitates, first, a transmission electron image of TEM (transmission electron microscope) of 150,000 magnifications was binarized by the aforementioned "WinROOF", and the precipitates were extracted. Then, an average value of an area of each precipitate was calculated, and the grain diameter calculated from the average value of the area was set as an average grain diameter. A ratio of the number of precipitates of 30 nm or less was measured from the grain diameter of each precipitate. However, in the transmission electron image of the TEM of 150,000 magnifications, even when the obtained image was further magnified, observation of just only 1 nm was possible. Accordingly, the ratio was a ratio in the precipitates larger than 1 nm. It was considered that there was a problem for the precipitated grains smaller than 2 nm in consideration of measurement precision of size, but the measurement was continued as it was since the ratio occupied by the precipitates smaller than 2 nm was below 20% in all samples. The measurement of the precipitates was performed at the process center portion 4, and was performed partially also at the recrystallized part of the process end portion 5. When the metal structure is in the non-recrystallized state, transition potential density is high. Accordingly, it is difficult to measure the precipitates using the TEM. Therefore, the precipitates at the non-recrystallized part were excepted from the parts measured by the TEM.

Thermal conductivity was assessed by the aforementioned electrical conductivity as a substitution property. Electrical conductivity and thermal conductivity are substantially in a linear positive correlation, and the electrical conductivity is generally used instead of the thermal conductivity. A conductivity measuring device was a SIGMA TEST D2.068 manufactured by FOERSTER JAPAN Co., Ltd. In the specification, the terms of "electrical conductivity" and "conductivity" are used as the same meaning.

With respect to the above-described test, difference caused by the initial difference in composition will be described by comparing the invention alloys with C1220. Tables 2 and 3 show test results of the pressure-resistance and heat-transfer vessel produced by creating a unprocessed tube having an outer diameter of 50 mm and a thickness of 1 mm with respect to each alloy by the process pattern A, and drawing both ends of the unprocessed tube into an outer diameter of 14.3 mm and a thickness of 1.1 mm by a spinning process. In Tables, $PI_B$, $PI_{0.5\%}$, and $PI_{1\%}$ are represented by PI(B), PI(0.5%), and PI(1%), respectively. The same sample for the test may be described as different Test No. in each Table of the test results (e.g., a sample of Test No. 1 in Tables 2 and 3 is the same as a sample of Test No. 81 in Tables 12 and 13).

TABLE 2

| | | | | Unprocessed Tube Size | | Drawing Portion Size | | | | |
|---|---|---|---|---|---|---|---|---|---|---|
| | | | | Outer | | Outer | | Pressure resistance | | |
| | Alloy No. | Process Pattern | Test No. | Diameter mm | Thickness mm | Diameter mm | Thickness mm | PI (B) | PI (0.5%) | PI (1%) |
| First Inv. | 1 | A | 1 | 50 | 1 | 14.3 | 1.1 | 1050 | 955 | 995 |
| Alloy | 2 | A | 2 | 50 | 1 | 14.3 | 1.1 | 885 | 755 | 840 |
| | 3 | A | 3 | 50 | 1 | 14.3 | 1.1 | 1150 | 1050 | 1115 |
| Second Inv. Alloy | 6 | A | 4 | 50 | 1 | 14.3 | 1.1 | 875 | 790 | 855 |
| Third Inv. Alloy | 7 | A | 5 | 50 | 1 | 14.3 | 1.1 | 1175 | 1095 | 1135 |
| Fourth | 8 | A | 6 | 50 | 1 | 14.3 | 1.1 | 970 | 885 | 940 |
| Inv. | 10 | A | 7 | 50 | 1 | 14.3 | 1.1 | 1090 | 1000 | 1060 |
| Alloy | 12 | A | 8 | 50 | 1 | 14.3 | 1.1 | 985 | 910 | 955 |
| | 13 | A | 9 | 50 | 1 | 14.3 | 1.1 | 1035 | 950 | 995 |
| | 15 | A | 10 | 50 | 1 | 14.3 | 11 | 1040 | 960 | 1000 |
| Third Inv. Alloy | 16 | A | 11 | 50 | 1 | 14.3 | 1 1 | 1050 | 985 | 1015 |
| Comp. | 23 | A | 12 | 50 | 1 | 14.3 | 1.1 | 525 | 200 | 265 |
| | 27 | A | 13 | 50 | 1 | 14.3 | 1.1 | 560 | 250 | 305 |
| C1220 | 31 | A | 14 | 50 | 1 | 14.3 | 1.1 | 485 | 145 | 195 |

| | Recrystallization Ratio (%) | | | | | | | |
|---|---|---|---|---|---|---|---|---|
| | | Drawing-Processed Portion | | | Avg. of Heat-Influenced Portion and Process End Portion | Crystal Grain Diameter Process | Precipitates (Process End Portion) | |
| | Straight Tube Portion | Heat-Influenced Portion | Process End Portion | Process Center Portion | (Drawing-Processed Portion) | Center Portion μm | Avg. Diameter nm | 30 nm or less % |
| First Inv. | 0 | 0 | 10 | 100 | 5 | 14 | 3.5 | 99 |
| Alloy | 0 | 0 | 40 | 100 | 20 | 17 | | |
| | 0 | 0 | 10 | 100 | 5 | 7.5 | | |
| Second Inv. Alloy | 0 | 0 | 30 | 100 | 15 | 17 | | |
| Third Inv. Alloy | 0 | 0 | 5 | 100 | 3 | 10 | | |
| Fourth | 0 | 0 | 15 | 100 | 8 | 14 | | |
| Inv. | 0 | 0 | 10 | 100 | 5 | 10 | 3.4 | 99 |
| Alloy | 0 | 0 | 20 | 100 | 10 | 14 | | |
| | 0 | 0 | 15 | 100 | 8 | 10 | | |
| | 0 | 0 | 10 | 100 | 5 | 10 | | |
| Third Inv. Alloy | 0 | 0 | 10 | 100 | 5 | 10 | | |
| Comp. | 0 | 100 | 100 | 100 | 100 | 53 | | |
| | 0 | 50 | 100 | 100 | 75 | 38 | | |
| C1220 | 0 | 100 | 100 | 100 | 100 | 120 | | |

TABLE 3

| | Alloy No. | Process Pattern | Test No. | Precipitates (Process Center Portion) Avg. Diameter nm | Precipitates (Process Center Portion) 30 nm or less % | Vickers Hardness (HV) Straight Tube Portion | Vickers Hardness (HV) Drawing-Processed Portion Heat-Influenced Portion | Vickers Hardness (HV) Drawing-Processed Portion Process End Portion | Vickers Hardness (HV) Process Center Portion |
|---|---|---|---|---|---|---|---|---|---|
| First Inv. | 1 | A | 1 | 13 | 98 | 148 | 143 | 108 | 72 |
| Alloy | 2 | A | 2 | | | 138 | 128 | 96 | 65 |
| | 3 | A | 3 | 16 | 94 | 156 | 153 | 122 | 79 |
| Second Inv. Alloy | 6 | A | 4 | | | 139 | 130 | 97 | 66 |
| Third Inv. Alloy | 7 | A | 5 | 14 | 96 | 167 | 163 | 118 | 74 |
| Forth | 8 | A | 6 | | | 144 | 137 | 106 | 72 |
| Inv. | 10 | A | 7 | 12 | 97 | 151 | 146 | 110 | 68 |
| Alloy | 12 | A | 8 | | | 145 | 140 | 103 | 69 |
| | 13 | A | 9 | | | 149 | 143 | 106 | 71 |
| | 15 | A | 10 | | | 150 | 143 | 105 | 74 |
| Third Inv. Alloy | 16 | A | 11 | | | 152 | 146 | 105 | 72 |
| Comp. | 23 | A | 12 | | | 122 | 63 | 55 | 44 |
| | 27 | A | 13 | | | 126 | 79 | 58 | 47 |
| C1220 | 31 | A | 14 | No Detecting | | 105 | 54 | 49 | 37 |

| | Conductivity (% IACS) Straight Tube Portion | Conductivity (% IACS) Drawing-Processed Portion Heat-Influenced Portion | Conductivity (% IACS) Drawing-Processed Portion Process End Portion | Conductivity (% IACS) Process Center Portion | 700° C. 20 Sec. Vickers Hardness (HV) Drawing-Processed Portion Heat-Influenced Portion | 700° C. 20 Sec. Vickers Hardness (HV) Drawing-Processed Portion Process End Portion | 700° C. 20 Sec. Recrystallization Ratio (%) Heat-Influenced Portion |
|---|---|---|---|---|---|---|---|
| First Inv. | 53 | 63 | 71 | 66 | 137 | 105 | |
| Alloy | 61 | 71 | 76 | 72 | 122 | 94 | 5 |
| | 51 | 58 | 68 | 62 | 145 | 119 | |
| Second Inv. Alloy | 58 | 69 | 75 | 70 | | | |
| Third Inv. Alloy | 52 | 66 | 73 | 70 | 153 | 115 | |
| Forth | 55 | 65 | 72 | 67 | 127 | 104 | |
| Inv. | 53 | 62 | 70 | 68 | 137 | 107 | 0 |
| Alloy | 53 | 63 | 71 | 64 | | | |
| | 56 | 67 | 74 | 70 | | | |
| | 52 | 63 | 72 | 65 | | | |
| Third Inv. Alloy | 51 | 61 | 68 | 63 | | | |
| Comp. | 62 | 68 | 72 | 69 | | | |
| | 44 | 56 | 66 | 61 | | | |
| C1220 85 | 86 | 86 | 87 | 42 | 39 | | |

FIG. 3 shows a metal structure of each part of the first invention alloy of Test No. 1 and C1220 of Test No. 14 described in Tables 2 and 3. FIG. 4 shows precipitates at the process end portion in the first invention alloy of Test No. 1 and the process center portion in the fourth invention alloy of Test No. 7 described in Tables 2 and 3. Since the precipitates of the process end portion were small, the obtained image was further magnified.

In C1220, the burst pressure index $PI_B$ is 500 or less. However, in the first, second, third, and fourth invention alloys, the burst pressure index $PI_B$ is 800 or more, which is a high value. The burst pressure index $PI_B$ may be 600 or more, preferably 700 or more, and most preferably 800 or more. A 0.5% deformation pressure index $PI_{0.5\%}$ representing the initial deformation pressure of C1220 is about 150, but that of each invention alloy is 750 or more, which is five or more times thereof. $PI_{0.50}$ may be 300 or more, preferably 350 or more, and most preferably 450 or more. A 1% deformation pressure index $PI_{1\%}$ of each invention alloy is four or more times of that in C1220. The $PI_{1\%}$ may be 350 or more, preferably 400 or more, and most preferably 500 or more. As described above, each invention alloy has pressure resistance higher than that of C1220, and particularly, there is a great difference in strength in the initial step of deformation.

The recrystallization ratio of C1220 is 0% at the straight tube portion 7, and is 100% at the heat-influenced portion 6, the process end portion 5, and the process center portion 4. The recrystallization ratio of each invention alloy is 0% at the straight tube portion 7 and the heat-influenced portion 6, and is 5 to 40% at the process end portion 5. The recrystallization ratio is 100% at the process center portion 4. Accordingly, there is a great difference at the heat-influenced portion 6 and the process end portion 5. The recrystallization ratio (average of the recrystallization ratios of the heat-influenced portion 6 and the process end portion 5) of C1220 is 100% at the drawing-processed portion 8, but the recrystallization ratio of each invention alloy is 20% or less at the drawing-processed portion 8. The recrystallization ratio of the drawing-processed portion 8 may be 50% or less, preferably 40% or less, and most preferably 25% or less. Since the pressure resistance is greatly affected by the strength of the heat-influenced portion 6 and the process end portion 5, the difference between the recrystallization ratios sufficiently coincides with the above-described result of the pressure resistance. A recrystallized grain diameter of the process center portion 4 in C1220 is 120 μm, but the recrystallized grain diameter in each invention alloy is 20 μm or less. The strength of the process center portion 4 in each invention alloy is higher than that of C1220.

The precipitates of the process center portion 4 and the process end portion 5 in Test No. 1, 3, 5, 7, and 14 of Tables 2 and 3 were observed. At the process center portion 4, substantially circular or substantially oval fine precipitates were uniformly precipitated in each invention alloy, and an average diameter thereof was 12 to 16 nm. A ratio of the number of precipitates having a diameter of 30 nm or less in all the precipitates was about 95%. In C1220, no precipitate was detected. It is considered that even when the temperature was increased to 800° C. or higher in the course of the spinning process by the fine precipitates, the growth of the crystal grains was suppressed and thus the strength was high. The observation at the process end portion 5 was performed in Test No. 1 and 7. Substantially circular or substantially oval precipitates were uniformly precipitated, and an average diameter of the precipitates was 3.5 nm in Test No. 1 and 3.4 nm in Test No. 7, which were finer than that of the process center portion 4. It is considered that even when the temperature was increased to about 700° C. or higher in the course of the spinning process, the invention alloy was enhanced by the fine precipitates, and softening of matrix was offset by generation or the like of partially-generated recrystallized nucleuses, thereby keeping the high strength. The precipitates of each sample after brazing were observed, which had the same shape as that before heating.

As described above, although the precipitates of Co, P, and the like are fine as the average grain diameter is 3 to 16 nm at each portion, they take two great roles in the high temperature state. One is that although the precipitates are completely recrystallized at the process center portion 4 when the temperature is increased to about 800° C. or higher in the course of the spinning process, the growth of the recrystallized grains is suppressed by the precipitates, thereby having the fine recrystallization structure. The other is that although the temperature of the process end portion 5 needing to have strength is increased to about 700° C. or about 750° C., the recrystallization is obstructed by forming the finer precipitates. Since the precipitates at the partially recrystallized part are fine, the high strength is kept by precipitation hardening. Since the precipitates of the heat-influenced portion 6, the temperature of which is increased to 500° C. or higher, have a processed structure, the precipitates cannot be observed. However, in the view point of increasing the conductivity, it is considered that the precipitates of Co, P, and the like having the same size as that of the process end portion 5 or smaller were formed. As described above, in the heat-influenced portion 6, matrix is slightly softened by the increase in temperature, but there is hardly any decrease in hardness due to the forming of the precipitates.

With respect to Vickers hardness, there is a difference between C1220 and each invention alloy, and particularly there is a great difference in the heat-influenced portion 6 and the process end portion 5 having an influence on pressure resistance. In C1220, Vickers hardness is about 50 at the heat-influenced portion 6 and the process end portion. However, in each invention alloy, Vickers hardness is 130 to 150 at the heat-influenced portion 6, and is about 100 to 110 at the process end portion 5. The result of the Vickers hardness sufficiently coincides with the recrystallization ratio. The Vickers hardness after heating at 700° C. for 20 seconds is decreased by only about 2 to 10 points as compared with that of the heat-influenced portion 6 and the process end portion 5 of the original sample, and all of the Vickers hardness are 90 or more. Accordingly, it is considered that the pressure-resistance and heat-transfer vessel has a high strength even when brazing with another copper tube in various conditions. All the recrystallization ratios of the heat-influenced portion 6 after the heating are 10% or less, and the high heat resistance is kept.

A conductivity at each part in C1220 is about 80% IACS. However, a conductivity at each part in each invention alloy is about 50 to 80% IACS, which is substantially equivalent to the conductivity of C1220.

In the case of C1220, the initial value of the Vickers hardness after the heating at 700° C. for 20 seconds is low, and is decreased by about 10 as compared with the case before the heating. However, in the invention alloy, the Vickers hardness after the heating is equivalent to that before the heating, and the recrystallization was not progressed. As can be seen from this result and the above-described pressure resistance, the invention alloy has an excellent heat resistance.

Tables 4 and 5 show data when an unprocessed tube having an outer diameter of 50 mm and a thickness of 1.5 mm is subjected to a spinning process into an outer diameter of 17 mm and a thickness of 2 mm, and Tables 6 and 7 show data when an unprocessed tube having an outer diameter of 30 mm and a thickness of 1 mm is subjected to a spinning process into an outer diameter of 12.3 mm and a thickness of 1.3 mm.

TABLE 4

| | | | | Unprocessed Tube Size | | Drawing Portion Size | | | | |
|---|---|---|---|---|---|---|---|---|---|---|
| | | | | Outer | | Outer | | Pressure Resistance | | |
| | Alloy No. | Process Pattern | Test No. | Diameter mm | Thickness mm | Diameter mm | Thickness mm | PI (B) | PI (0.5%) | PI (1%) |
| First Inv. Alloy | 1 | A | 21 | 50 | 1.5 | 17.0 | 2.0 | 1060 | 973 | 1023 |

TABLE 4-continued

| | | | | | | | | | | |
|---|---|---|---|---|---|---|---|---|---|---|
| Fourth | 9 | A | 22 | 50 | 1.5 | 17.0 | 2.0 | 917 | 833 | 890 |
| Inv. Alloy | 10 | A | 23 | 50 | 1.5 | 17.0 | 2.0 | 1087 | 1003 | 1057 |
| Third Inv. Alloy | 16 | A | 24 | 50 | 1.5 | 17.0 | 2.0 | 1047 | 970 | 1023 |
| Comp. | 22 | A | 25 | 50 | 1.5 | 17.0 | 2.0 | 540 | 203 | 277 |
| | 24 | A | 26 | 50 | 1.5 | 17.0 | 2.0 | 530 | 193 | 267 |
| C1220 | 31 | A | 27 | 50 | 1.5 | 17.0 | 2.0 | 460 | 123 | 167 |

| | Recrystallization Ratio (%) | | | | | Crystal Grain Diameter | Precipitates (Process End Portion) | |
|---|---|---|---|---|---|---|---|---|
| | | Drawing-Processed Portion | | | Avg. of Heat-Influenced Portion and Process End Portion | | | |
| | Straight Tube Portion | Heat-Influenced Portion | Process End Portion | Process Center Portion | (Drawing-Processed Portion) | Process Center Portion μm | Avg. Diameter nm | 30 nm or less % |
| First Inv. Alloy | 0 | 0 | 10 | 100 | 5 | 17 | | |
| Fourth | 0 | 0 | 30 | 100 | 15 | 19 | | |
| Inv. Alloy | 0 | 0 | 10 | 100 | 5 | 10 | | |
| Third Inv. Alloy | 0 | 0 | 10 | 100 | 5 | 14 | | |
| Comp. | 0 | 90 | 100 | 100 | 95 | 45 | | |
| | 0 | 100 | 100 | 100 | 100 | 53 | | |
| C1220 | 20 | 100 | 100 | 100 | 100 | 100 | | |

TABLE 5

| | | | | Precipitates (Process Center Portion) | | Vickers Hardness (HV) | | | |
|---|---|---|---|---|---|---|---|---|---|
| | | | | | | | Drawing-Processed Portion | | |
| | Alloy No. | Process Pattern | Test No. | Avg. Diameter nm | 30 nm or less % | Straight Tube Portion | Heat-Influenced Portion | Process End Portion | Process Center Portion |
| First Inv. Alloy | 1 | A | 21 | | | 146 | 139 | 111 | 71 |
| Fourth | 9 | A | 22 | | | 139 | 132 | 98 | 65 |
| Inv. Alloy | 10 | A | 23 | | | 146 | 142 | 112 | 73 |
| Third Inv. Alloy | 16 | A | 24 | | | 148 | 143 | 106 | 71 |
| Comp. | 22 | A | 25 | | | 123 | 68 | 57 | 46 |
| | 24 | A | 26 | | | 119 | 65 | 57 | 45 |
| C1220 | 31 | A | 27 | | | 97 | 52 | 48 | 36 |

| | Conductivity (% IACS) | | | | 700° C. 20 Sec. Vickers Hardness (HV) | | 700° C. 20 Sec. Recrystallization Ratio (%) |
|---|---|---|---|---|---|---|---|
| | | Drawing-Processed Portion | | | Drawing-Processed Portion | | |
| | Straight Tube Portion | Heat-Influenced Portion | Process End Portion | Process Center Portion | Heat-Influenced Portion | Process End Portion | Heat-Influenced Portion |
| First Inv. Alloy | 53 | 62 | 72 | 70 | | | |
| Fourth | 52 | 62 | 68 | 65 | | | |
| Inv. Alloy | 53 | 62 | 73 | 71 | | | |

TABLE 5-continued

| | | | | | | | |
|---|---|---|---|---|---|---|---|
| Third Inv. Alloy | 51 | 60 | 68 | 64 | | | |
| Comp. | 56 | 62 | 67 | 65 | 56 | | 100 |
| | 58 | 64 | 67 | 66 | | | |
| C1220 | 85 | 86 | 86 | 87 | 41 | 40 | |

TABLE 6

| | | | | Unprocessed Tube Size | | Drawing Portion Size | | | | |
|---|---|---|---|---|---|---|---|---|---|---|
| | | | | Outer | | Outer | | Pressure Resistance | | |
| | Alloy No. | Process Pattern | Test No. | Diameter mm | Thickness mm | Diameter mm | Thickness mm | PI (B) | PI (0.5%) | PI (1%) |
| Second Inv. Alloy | 4 | A | 31 | 30 | 1 | 12.3 | 1.3 | 1032 | 939 | 990 |
| | 5 | A | 32 | 30 | 1 | 12.3 | 1.3 | 936 | 834 | 900 |
| Fourth Inv. Alloy | 10 | A | 33 | 30 | 1 | 12.3 | 1.3 | 1035 | 936 | 993 |
| | 11 | A | 34 | 30 | 1 | 12.3 | 1.3 | 1149 | 1080 | 1131 |
| Third Inv. Alloy | 14 | A | 35 | 30 | 1 | 12.3 | 1.3 | 1089 | 1014 | 1050 |
| Comp. | 21 | A | 36 | 30 | 1 | 12.3 | 1.3 | 498 | 150 | 219 |
| | 25 | A | 37 | 30 | 1 | 12.3 | 1.3 | 516 | 159 | 243 |
| | 26 | A | 38 | 30 | 1 | 12.3 | 1.3 | 549 | 237 | 294 |
| | 28 | A | 39 | In producing a Tube of ϕ30 × 1t, cracks occur at the time of drawing. The later process cannot be progressed. | | | | | | |
| C1220 | 32 | A | 40 | 30 | 1 | 12.3 | 1.3 | 474 | 129 | 180 |

| | | Recrystallization Ratio (%) | | | | | | | |
|---|---|---|---|---|---|---|---|---|---|
| | | | Drawing-Processed Portion | | | Avg. of Heat-Influenced Portion and Process End Portion | Crystal Grain Diameter | Precipitates (Process End Portion) | |
| | Alloy No. | Straight Tube Portion | Heat-Influenced Portion | Process End Portion | Process Center Portion | (Drawing-Processed Portion) | Process Center Portion μm | Avg. Diameter nm | 30 nm or less % |
| Second Inv. Alloy | 4 | 0 | 0 | 10 | 100 | 5 | 14 | | |
| | 5 | 0 | 0 | 20 | 100 | 10 | 14 | | |
| Fourth Inv. Alloy | 10 | 0 | 0 | 10 | 100 | 5 | 10 | | |
| | 11 | 0 | 0 | 5 | 100 | 3 | 7.5 | | |
| Third Inv. Alloy | 14 | 0 | 0 | 10 | 100 | 5 | 7.5 | | |
| Comp. | 21 | 10 | 100 | 100 | 100 | 100 | 60 | | |
| | 25 | 0 | 100 | 100 | 100 | 100 | 60 | | |
| | 26 | 0 | 75 | 100 | 100 | 88 | 45 | | |
| | 28 | In producing a Tube of ϕ30 × 1t, cracks occur at the time of drawing. The later process cannot be progressed. | | | | | | | |
| C1220 | 32 | 10 | 100 | 100 | 100 | 100 | 100 | | |

TABLE 7

| | Alloy No. | Process Pattern | Test No. | Precipitates (Process Center Portion) Avg. Diameter nm | Precipitates (Process Center Portion) 30 nm or less % | Vickers Hardness (HV) Straight Tube Portion | Vickers Hardness (HV) Drawing-Processed Portion Heat-Influenced Portion | Vickers Hardness (HV) Drawing-Processed Portion Process End Portion | Vickers Hardness (HV) Drawing-Processed Portion Process Center Portion |
|---|---|---|---|---|---|---|---|---|---|
| Second Inv. Alloy | 4 | A | 31 | | | 151 | 145 | 109 | 71 |
| | 5 | A | 32 | | | 146 | 136 | 104 | 70 |
| Fourth Inv. Alloy | 10 | A | 33 | | | 152 | 148 | 109 | 73 |
| | 11 | A | 34 | | | 168 | 161 | 114 | 79 |
| Third Inv. Alloy | 14 | A | 35 | | | 161 | 155 | 113 | 77 |
| Comp. | 21 | A | 36 | | | 116 | 59 | 52 | 41 |
| | 25 | A | 37 | | | 114 | 61 | 54 | 42 |
| | 26 | A | 38 | | | 128 | 74 | 59 | 49 |
| | 28 | A | 39 | | | | | | |
| C1220 | 32 | A | 40 | | | 109 | 52 | 48 | 35 |

| | Alloy No. | Conductivity (% IACS) Straight Tube Portion | Conductivity (% IACS) Drawing-Processed Portion Heat-Influenced Portion | Conductivity (% IACS) Drawing-Processed Portion Process End Portion | Conductivity (% IACS) Process Center Portion | 700° C. 20 Sec. Vickers Hardness (HV) Drawing-Processed Portion Heat-Influenced Portion | 700° C. 20 Sec. Vickers Hardness (HV) Drawing-Processed Portion Process End Portion | 700° C. 20 Sec. Recrystallization Ratio (%) Heat-Influenced Portion |
|---|---|---|---|---|---|---|---|---|
| Second Inv. Alloy | 4 | 54 | 63 | 69 | 65 | 140 | 106 | |
| | 5 | 50 | 60 | 66 | 63 | | | |
| Fourth Inv. Alloy | 10 | 53 | 64 | 72 | 70 | | | |
| | 11 | 51 | 64 | 71 | 66 | | | |
| Third Inv. Alloy | 14 | 53 | 63 | 71 | 66 | | | |
| Comp. | 21 | 64 | 65 | 66 | 66 | | | |
| | 25 | 65 | 72 | 78 | 76 | | | |
| | 26 | 48 | 55 | 64 | 59 | 58 | | 100 |
| | 28 | | | | | | | |
| C1220 | 32 | 84 | 86 | 86 | 86 | | | |

Similarly with the case of the sizes in the unprocessed tubes of Tables 2 and 3, each invention alloy has strength higher than that of C1220 and has the equivalent conductivity also in Tables 4 and 5 and Tables 6 and 7.

Next, properties in the case where an alloy composition deviates from the composition range of the invention alloy will be described. The alloys of Test No. 12 in Tables 2 and 3, Test No. 25 and 26 in Tables 4 and 5, and Test No. 36 in Tables 6 and 7 have a content of P smaller than that of the invention alloy. All the alloys have low pressure resistance, a high recrystallization ratio at the heat-influenced portion 6 or the process end portion 5, and low Vickers hardness, as compared with those of the invention alloy. The reason may be that the content of P is small and thus the amount of the precipitation of Co, P, and the like is small.

The alloy of Test No. 37 in Tables 6 and 7 has contents of P and Co smaller than the range of each invention alloy. The alloy has low pressure resistance, a high recrystallization ratio at the heat-influenced portion 6 or the process end portion 5, and low Vickers hardness, as compared with the invention alloy. The reason may be that the contents of P and Co are small and thus the amount of the precipitation of Co, P, and the like is small.

The alloy of Test No. 13 in Tables 2 and 3 has a value of ([Co]−0.007)/([P]−0.008) larger than the range of the invention alloy. The alloy has low pressure resistance, a high recrystallization ratio at the heat-influenced portion 6 or the process end portion 5, and low Vickers hardness, as compared with the invention alloy.

The alloy of Test No. 38 in Tables 6 and 7 has a value of (1.5×[Ni]+3×[Fe]) larger than a value of [Co]. As compared with the invention alloy, pressure resistance is low, a recrystallization ratio is high at the heat-influenced portion 6 or the process end portion 5, and Vickers hardness is low.

The alloy of Test No. 39 in Tables 6 and 7 has a content of P larger than the range of the invention alloy, in which cracks occur at the time of drawing and thus an unprocessed tube could not be obtained.

Next, formability and deformation resistance at the time of the spinning process will be described. In the spinning process of each test in Tables 2 to 7, when the outer diameter of the unprocessed tube is 50 mm, the drawing process is performed at 1200 rpm and an average conveying speed of 15 mm/second. When the outer diameter of the unprocessed tube is 30 mm, the drawing process is performed at 1400 rpm and an average conveying speed of 35 mm/second. In the test of Tables 8 and 9, the thickness of the unprocessed tube is different from those of Tables 2 to 7. Table 8 and Table 9 show the result obtained by performing the spinning process on the unprocessed tube having an outer diameter of 50 mm and a thickness of 0.5 to 1 mm and the unprocessed tube having an outer diameter of 30 mm and a thickness of 0.4 to 1.25 mm, in which the test conditions of the number of rotation and the conveying speed are set in the same as those of the test of the same outer diameter in Tables 2 to 7.

TABLE 8

| | | | | Unprocessed Tube Size | | Drawing Portion Size | | | | |
|---|---|---|---|---|---|---|---|---|---|---|
| | | | | Outer | | Outer | | Pressure Resistance | | |
| | Alloy No. | Process Pattern | Test No. | Diameter mm | Thickness mm | Diameter mm | Tickness mm | PI (B) | PI (0.5%) | PI (1%) |
| First Inv. | 3 | A | 41 | 50 | 0.5 | 14.3 | 1.1 | 1130 | 1040 | 1090 |
| Alloy | 3 | A | 42 | 50 | 0.7 | 14.3 | 1.1 | 1136 | 1057 | 1100 |
| | 3 | A | 43 | 50 | 1 | 14.3 | 1.1 | 1150 | 1050 | 1115 |
| Fourth | 10 | A | 44 | 50 | 0.5 | 14.3 | 1.1 | 1040 | 990 | 1020 |
| Inv. | 10 | A | 45 | 50 | 0.7 | 14.3 | 1.1 | 1050 | 993 | 1021 |
| Alloy | 10 | A | 46 | 50 | 1 | 14.3 | 1.1 | 1090 | 1000 | 1060 |
| Third | 16 | A | 47 | 50 | 0.7 | 14.3 | 1.1 | 1036 | 957 | 1007 |
| Inv. | 16 | A | 48 | 50 | 1 | 14.3 | 1.1 | 1050 | 985 | 1015 |
| Alloy | | | | | | | | | | |
| Second | 4 | A | 49 | 30 | 0.4 | 11.1 | 0.7 | 1035 | 968 | 998 |
| Inv. | 4 | A | 50 | 30 | 0.6 | 11.7 | 1.0 | 1040 | 955 | 1010 |
| Alloy | 4 | A | 51 | 30 | 1 | 12.3 | 1.3 | 1032 | 939 | 990 |
| Fourth | 10 | A | 52 | 30 | 0.4 | 11.1 | 0.7 | 1028 | 960 | 990 |
| Inv. | 10 | A | 53 | 30 | 0.6 | 11.7 | 1.0 | 1050 | 965 | 1015 |
| Alloy | 10 | A | 54 | 30 | 1 | 12.3 | 1.3 | 1035 | 936 | 993 |
| | 10 | A | 55 | 30 | 1.3 | 12.5 | 1.4 | 1061 | 984 | 1030 |

| | | Recrystallization Ratio (%) | | | | | | | |
|---|---|---|---|---|---|---|---|---|---|
| | | | Drawing-Processed Portion | | | | | Precipitates (Process End Portion) | |
| | Alloy No. | Straight Tube Portion | Heat-Influenced Portion | Porcess End Portion | Porcess Center Portion | Avg. of Heat-Influenced Portion and Process End Portion (Drawing-Processed Portion) | Crystal Grain Diameter Process Center Portion μm | Avg. Diameter nm | 30 nm or less % |
| First Inv. | 3 | 0 | 0 | 5 | 100 | 3 | 5 | | |
| Alloy | 3 | 0 | 0 | 5 | 100 | 3 | 7.5 | | |
| | 3 | 0 | 0 | 10 | 100 | 5 | 7.5 | | |
| Fourth | 10 | 0 | 0 | 10 | 100 | 5 | 7.5 | 3.5 | 9.9 |
| Inv. | 10 | 0 | 0 | 10 | 100 | 5 | 7.5 | | |
| Alloy | 10 | 0 | 0 | 10 | 100 | 5 | 10 | 3.4 | 99 |
| Third | 16 | 0 | 0 | 10 | 100 | 5 | 10 | | |
| Inv. | 16 | 0 | 0 | 10 | 100 | 5 | 10 | | |
| Alloy | | | | | | | | | |
| Second | 4 | 0 | 0 | 5 | 100 | 3 | 10 | | |
| Inv. | 4 | 0 | 0 | 10 | 100 | 5 | 10 | | |
| Alloy | 4 | 0 | 0 | 10 | 100 | 5 | 14 | | |
| Fourth | 10 | 0 | 0 | 10 | 100 | 5 | 7.5 | | |
| Inv. | 10 | 0 | 0 | 10 | 100 | 5 | 10 | | |
| Alloy | 10 | 0 | 0 | 10 | 100 | 5 | 10 | | |
| | 10 | 0 | 0 | 10 | 100 | 5 | 10 | | |

TABLE 9

| | | | | Precipitates (Process Center Portion) | | Vickers Hardness (HV) | | | |
|---|---|---|---|---|---|---|---|---|---|
| | | | | | | | Drawing-Processed Portion | | |
| | Alloy No. | Process Pattern | Test No. | Avg. Diameter nm | 30 nm or less % | Straight Tube Portion | Heat-Influenced Portion | Process End Portion | Process Center Portion |
| First Inv. | 3 | A | 41 | | | 167 | 159 | 116 | 83 |
| Alloy | 3 | A | 42 | | | 160 | 157 | 117 | 77 |
| | 3 | A | 43 | 16 | 94 | 156 | 153 | 122 | 79 |
| Fourth | 10 | A | 44 | 13 | 98 | 157 | 153 | 107 | 78 |
| Inv. | 10 | A | 45 | | | 152 | 147 | 106 | 76 |

TABLE 9-continued

| | | | | | | | | | |
|---|---|---|---|---|---|---|---|---|---|
| Alloy | 10 | A | 46 | 12 | 97 | 151 | 146 | 110 | 68 |
| Third | 16 | A | 47 | | | 154 | 147 | 108 | 74 |
| Inv. | 16 | A | 48 | | | 152 | 146 | 105 | 72 |
| Alloy | | | | | | | | | |
| Second | 4 | A | 49 | 12 | 97 | 156 | 149 | 111 | 74 |
| Inv. | 4 | A | 50 | | | 153 | 147 | 110 | 74 |
| Alloy | 4 | A | 51 | | | 151 | 145 | 109 | 71 |
| Fourth | 10 | A | 52 | | | 160 | 154 | 107 | 76 |
| Inv. | 10 | A | 53 | | | 157 | 153 | 108 | 72 |
| Alloy | 10 | A | 54 | | | 152 | 148 | 109 | 73 |
| | 10 | A | 55 | | | 150 | 147 | 111 | 72 |

| | | | | | | 700° C. 20 Sec. | | |
|---|---|---|---|---|---|---|---|---|
| | | Conductivity (% IACS) | | | | Vickers Hardness (HV) | | |
| | | | Drawing-Processed Portion | | | Drawing-Processed Portion | | Recrystallization Ratio (%) |
| | Alloy No. | Straight Tube Portion | Heat-Influenced Portion | Process End Portion | Process Center Portion | Heat-Influenced Portion | Process End Portion | Heat-Influenced Portion |
| First Inv. | 3 | 51 | 57 | 68 | 60 | 148 | 113 | |
| Alloy | 3 | 52 | 58 | 70 | 61 | 146 | 114 | |
| | 3 | 51 | 58 | 68 | 62 | 145 | 119 | |
| Fourth | 10 | 52 | 61 | 71 | 64 | | | |
| Inv. | 10 | 52 | 63 | 72 | 65 | | | |
| Alloy | 10 | 53 | 62 | 70 | 68 | 137 | 107 | 0 |
| Third | 16 | 50 | 60 | 67 | 62 | | | |
| Inv. | 16 | 51 | 61 | 68 | 63 | | | |
| Alloy | | | | | | | | |
| Second | 4 | 53 | 60 | 66 | 62 | 141 | 109 | |
| Inv. | 4 | 54 | 62 | 68 | 63 | 139 | 106 | |
| Alloy | 4 | 54 | 63 | 69 | 65 | 140 | 106 | |
| Fourth | 10 | 53 | 62 | 69 | 66 | | | |
| Inv. | 10 | 53 | 61 | 70 | 67 | | | |
| Alloy | 10 | 53 | 64 | 72 | 70 | | | |
| | 10 | 54 | 64 | 72 | 72 | | | |

All invention alloys in Tables 2 to 9 could be processed without defect in forming. As described above, no defect in forming occurs and the process center portion 4 is recrystallized. Accordingly, in the invention alloy, the deformation resistance in the course of the spinning process is low in these process conditions.

Tables 10 and 11 show examples in which the process conditions are additionally changed.

TABLE 10

| | | | | | | Unprocessed Tube Size | | Drawing Portion Size | | | | |
|---|---|---|---|---|---|---|---|---|---|---|---|---|
| | | | | Number of | Conveying | Outer | | Outer | | Pressure Resistance | | |
| | Alloy No. | Process Pattern | Test No. | Rotation rpm | Speed mm/s | Diameter mm | Thickness mm | Diameter mm | Thickness mm | PI (B) | PI (0.5%) | PI (1%) |
| Second Inv. | 4 | A | 61 | 1800 | 40 | 30 | 0.6 | 11.7 | 1.0 | 1050 | 955 | 1015 |
| Alloy | 4 | A | 62 | 1200 | 20 | 30 | 0.6 | 11.7 | 1.0 | 1025 | 935 | 1000 |
| Fourth Inv. | 10 | A | 63 | 1800 | 40 | 30 | 0.6 | 11.7 | 1.0 | 1035 | 950 | 1005 |
| Alloy | 10 | A | 64 | 1200 | 20 | 30 | 0.6 | 11.7 | 1.0 | 1025 | 920 | 995 |
| | 10 | A | 65 | 1800 | 40 | 30 | 1.3 | 12.5 | 1.4 | 1063 | 991 | 1034 |
| | 10 | A | 66 | 1200 | 20 | 30 | 1.3 | 12.5 | 1.4 | 1056 | 967 | 1025 |
| First Inv. | 1 | A | 67 | 1600 | 20 | 50 | 1 | 14.3 | 1.1 | 1035 | 945 | 990 |
| Alloy | 1 | A | 68 | 900 | 20 | 50 | 1 | 14.3 | 1.1 | 1070 | 930 | 1000 |
| Second Inv. | 6 | A | 69 | 900 | 20 | 50 | 1 | 14.3 | 1.1 | 885 | 800 | 845 |
| Alloy | | | | | | | | | | | | |
| Third Inv. | 7 | A | 70 | 1600 | 20 | 50 | 1 | 14.3 | 1.1 | 1160 | 1085 | 1115 |
| Alloy | | | | | | | | | | | | |
| Fourth Inv. | 15 | A | 71 | 1600 | 20 | 50 | 1 | 14.3 | 1.1 | 1030 | 940 | 990 |
| Alloy | 15 | A | 72 | 900 | 20 | 50 | 1 | 14.3 | 1.1 | 1050 | 960 | 1010 |

TABLE 10-continued

| | Alloy No. | Recrystallization Ratio (%) Straight Tube Portion | Drawing-Processed Portion Heat-Influenced Portion | Drawing-Processed Portion Process End Portion | Process Center Portion | Avg. of Heat-Influenced Portion and Process End Portion (Drawing-Processed Portion) |
|---|---|---|---|---|---|---|
| Second Inv. | 4 | 0 | 0 | 10 | 100 | 5 |
| Alloy | 4 | 0 | 0 | 10 | 100 | 5 |
| Fourth Inv. | 10 | 0 | 0 | 10 | 100 | 5 |
| Alloy | 10 | 0 | 0 | 10 | 100 | 5 |
| | 10 | 0 | 0 | 10 | 100 | 5 |
| | 10 | 0 | 0 | 10 | 100 | 5 |
| First Inv. | 1 | 0 | 0 | 10 | 100 | 5 |
| Alloy | 1 | 0 | 0 | 10 | 100 | 5 |
| Second Inv. Alloy | 6 | 0 | 0 | 25 | 100 | 13 |
| Third Inv. Alloy | 7 | 0 | 0 | 5 | 100 | 3 |
| Fourth Inv. | 15 | 0 | 0 | 10 | 100 | 5 |
| Alloy | 15 | 0 | 0 | 10 | 100 | 5 |

TABLE 11

| | Alloy No. | Process Pattern | Test No. | Crystal Grain Diameter Process Center Portion μm | Precipitates (Process Center Portion) Avg. Diameter nm | 30 nm or less % | Vickers Hardness (HV) Straight Tube Portion | Drawing-Processed Portion Heat-Influenced Portion | Drawing-Processed Portion Process End Portion | Process Center Portion | Conductivity (% IACS) Straight Tube Portion | Drawing-Processed Portion Heat-Influenced Portion | Drawing-Processed Portion Process End Portion | Process Center Portion |
|---|---|---|---|---|---|---|---|---|---|---|---|---|---|---|
| Second | 4 | A | 61 | 10 | | | 153 | 147 | 109 | 74 | 54 | 61 | 68 | 63 |
| Inv. | 4 | A | 62 | 10 | | | 152 | 143 | 111 | 73 | 54 | 64 | 70 | 66 |
| Alloy | | | | | | | | | | | | | | |
| Fourth | 10 | A | 63 | 10 | | | 157 | 152 | 107 | 73 | 53 | 60 | 70 | 66 |
| Inv. | 10 | A | 64 | 10 | | | 156 | 151 | 105 | 71 | 54 | 63 | 71 | 68 |
| Alloy | 10 | A | 65 | 10 | | | 150 | 147 | 110 | 72 | 54 | 63 | 71 | 69 |
| | 10 | A | 66 | 14 | | | 149 | 145 | 112 | 70 | 55 | 66 | 74 | 72 |
| First Inv. | 1 | A | 67 | 14 | | | 148 | 143 | 108 | 73 | 53 | 63 | 72 | 66 |
| Alloy | 1 | A | 68 | 10 | | | 147 | 144 | 110 | 73 | 53 | 64 | 70 | 67 |
| Second | 6 | A | 69 | 14 | | | 139 | 132 | 99 | 66 | 58 | 70 | 75 | 70 |
| Inv. | | | | | | | | | | | | | | |
| Alloy | | | | | | | | | | | | | | |
| Third Inv. | 7 | A | 70 | 10 | | | 167 | 164 | 117 | 73 | 52 | 66 | 72 | 68 |
| Alloy | | | | | | | | | | | | | | |
| Fourth | 15 | A | 71 | 10 | | | 150 | 143 | 104 | 73 | 52 | 63 | 71 | 66 |
| Inv. | 15 | A | 72 | 10 | | | 150 | 142 | 106 | 75 | 52 | 64 | 73 | 65 |
| Alloy | | | | | | | | | | | | | | |

In the various invention alloys, the drawing was performed at an average conveying speed of 20 mm/second and 1200 rpm, and at an average conveying speed of 40 mm/second and 1800 rpm into an unprocessed tube having an outer diameter of 30 mm and a thickness of 0.6 mm and 1.25 mm. In addition, the drawing was performed at an average conveying speed of 20 mm/second, 900 rpm and 1600 rpm into an unprocessed tube having an outer diameter of 50 mm and a thickness of 1 mm. In any test, no defect in forming occurs, and the process center portion 4 was recrystallized. Accordingly, the deformation resistance in the course of the spinning process is low, and there is no problem in properties such as pressure resistance. In the spinning process, when the thickness of the unprocessed tube is smaller than 1 mm, defect in forming occurs in C1220 Therefore, the workability of the invention alloy is more satisfactory.

Next, the influence of the producing process will be described. Tables 12 and 13 show data at the time when an unprocessed tube having an outer diameter of 50 mm and a thickness of 1 mm or having an outer diameter of 30 mm and a thickness of 1 mm according to the process patterns A to D using the first, second, and fourth invention alloy is produced, and the drawing process is performed into an outer diameter of 14.3 mm and a thickness of 1.1 mm or into an outer diameter of 12.3 mm and a thickness of 1.3 mm.

TABLE 12

| | | | | Unprocessed Tube Size | | Drawing Portion Size | | | | |
|---|---|---|---|---|---|---|---|---|---|---|
| | | | | Outer | | Outer | | Pressure Resistance | | |
| | Alloy No. | Process Pattern | Test No. | Diameter mm | Thickness mm | Diameter Mm | Thickness mm | PI (B) | PI (0.5%) | PI (1%) |
| First Inv. | 1 | A | 81 | 50 | 1 | 14.3 | 1.1 | 1050 | 955 | 995 |
| Alloy | 1 | B | 82 | 50 | 1 | 14.3 | 1.1 | 990 | 885 | 935 |
| | 1 | C | 83 | 50 | 1 | 14.3 | 1.1 | 1030 | 910 | 965 |
| | 1 | D | 84 | 50 | 1 | 14.3 | 1.1 | 1040 | 905 | 950 |
| Second | 4 | A | 85 | 30 | 1 | 12.3 | 1.3 | 1032 | 939 | 990 |
| Inv. | 4 | B | 86 | 30 | 1 | 12.3 | 1.3 | 984 | 891 | 939 |
| Alloy | 4 | C | 87 | 30 | 1 | 12.3 | 1.3 | 1002 | 885 | 939 |
| | 4 | D | 88 | 30 | 1 | 12.3 | 1.3 | 1035 | 900 | 957 |
| Fourth | 10 | A | 89 | 50 | 1 | 14.3 | 1.1 | 1090 | 1000 | 1060 |
| Inv. | 10 | B | 90 | 50 | 1 | 14.3 | 1.1 | 1025 | 940 | 980 |
| Alloy | 10 | C | 91 | 50 | 1 | 14.3 | 1.1 | 1070 | 950 | 1065 |
| | 10 | D | 92 | 50 | 1 | 14.3 | 1.1 | 1095 | 940 | 1050 |

| | | Recrystallization Ratio (%) | | | | | | | |
|---|---|---|---|---|---|---|---|---|---|
| | | | Drawing-Processed Portion | | | Avg. of Heat-Influenced Portion and Process End Portion | Crystal Grain Diameter | Precipitates (Process End Portion) | |
| | Alloy No. | Straight Tube Portion | Heat-Influenced Portion | Process End Portion | Process Center Portion | (Drawing-Processed Portion) | Process Center Portion μm | Avg. Diameter nm | 30 nm or less % |
| First Inv. | 1 | 0 | 0 | 10 | 100 | 5 | 14 | 3.5 | 99 |
| Alloy | 1 | 0 | 0 | 15 | 100 | 8 | 17 | 5.1 | 97 |
| | 1 | 0 | 0 | 10 | 100 | 5 | 10 | 3.6 | 99 |
| | 1 | 0 | 0 | 10 | 100 | 5 | 10 | 3.3 | 99 |
| Second | 4 | 0 | 0 | 10 | 100 | 5 | 14 | | |
| Inv. | 4 | 0 | 0 | 15 | 100 | 8 | 17 | | |
| Alloy | 4 | 0 | 0 | 10 | 100 | 5 | 10 | | |
| | 4 | 0 | 0 | 10 | 100 | 5 | 14 | | |
| Fourth | 10 | 0 | 0 | 10 | 100 | 5 | 10 | 3.4 | 99 |
| Inv. | 10 | 0 | 0 | 20 | 100 | 10 | 14 | | |
| Alloy | 10 | 0 | 0 | 5 | 100 | 3 | 10 | | |
| | 10 | 0 | 0 | 10 | 100 | 5 | 10 | | |

TABLE 13

| | | | | Precipitates (Process Center Portion) | | Vickers Hardness (HV) Drawing-Processed Portion | | | |
|---|---|---|---|---|---|---|---|---|---|
| | Alloy No. | Process Pattern | Test No. | Avg. Diameter nm | 30 nm or less % | Straight Tube Portion | Heat-Influenced Portion | Process End Portion | Process Center Portion |
| First Inv. | 1 | A | 81 | 13 | 98 | 148 | 143 | 108 | 72 |
| Alloy | 1 | B | 82 | 14 | 97 | 144 | 133 | 103 | 68 |
| | 1 | C | 83 | 99 | 99 | 140 | 141 | 110 | 74 |
| | 1 | D | 84 | 6 | 99 | 139 | 135 | 113 | 91 |
| Second | 4 | A | 85 | | | 151 | 145 | 109 | 71 |
| Inv. | 4 | B | 86 | | | 146 | 137 | 104 | 69 |
| Alloy | 4 | C | 87 | | | 145 | 141 | 107 | 75 |
| | 4 | D | 88 | 8 | 100 | 142 | 142 | 109 | 89 |
| Fourth | 10 | A | 89 | 12 | 97 | 151 | 146 | 110 | 68 |
| Inv. | 10 | B | 90 | 13 | 98 | 147 | 139 | 107 | 66 |
| Alloy | 10 | C | 91 | 10 | 98 | 146 | 142 | 112 | 73 |
| | 10 | D | 92 | 8 | 99 | 144 | 145 | 116 | 88 |

TABLE 13-continued

| | | Conductivity (% IACS) | | | | 700° C. 20 Sec. Vickers Hardness (HV) | | |
|---|---|---|---|---|---|---|---|---|
| | | | Drawing-Processed Portion | | | Drawing-Processed Portion | | Recrystallization Ratio (%) |
| | Alloy No. | Straight Tube Portion | Heat-Influenced Portion | Process End Portion | Process Center Portion | Heat-Influenced Portion | Process End Portion | Heat-Influenced Portion |
| First Inv. | 1 | 53 | 63 | 71 | 66 | 137 | 105 | |
| Alloy | 1 | 56 | 67 | 72 | 67 | 126 | 99 | 0 |
| | 1 | 79 | 81 | 72 | 70 | 131 | 107 | 0 |
| | 1 | 80 | 81 | 78 | 77 | 130 | 109 | 0 |
| Second | 4 | 54 | 63 | 69 | 65 | 140 | 106 | |
| Inv. | 4 | 56 | 64 | 73 | 68 | 128 | 100 | |
| Alloy | 4 | 77 | 79 | 74 | 70 | 132 | 103 | |
| | 4 | 81 | 82 | 77 | 73 | 133 | 105 | |
| Fourth | 10 | 53 | 62 | 70 | 68 | 137 | 107 | 0 |
| Inv. | 10 | 58 | 64 | 71 | 69 | | | |
| Alloy | 10 | 79 | 79 | 72 | 70 | | | |
| | 10 | 78 | 79 | 77 | 75 | 138 | 113 | 0 |

In Test No. 82, 86, and 90 performed according to the process pattern B, in which the cooling after extruding is compulsory air cooling, equivalent or slightly small values are represented in properties as compared with Test No. 81, 85, and 89 performed according to the process pattern A, in which the cooling after extruding is water cooling. When the cooling rate is high, more amounts of Co, P, and the like are further solid-dissolved. Accordingly, the pressure resistance or the like in the process pattern A is higher than that in the process pattern B. However, the sensitivity of solution of the invention alloy is insensitive. Accordingly, most of Co, P, and the like are solid-dissolved similarly with the water cooling even when the cooling after extruding is the compulsory air cooling. Therefore, there is little difference between the process pattern A and the process pattern B, and a satisfactory result is obtained even in the process pattern B.

In Test No. 83, 87, and 91 in which the heat treatment is performed at 395° C. for 240 minutes before the spinning process according to the process pattern C, pressure resistance, a recrystallization ratio, a crystal grain diameter, a precipitation state of precipitates, and Vickers hardness are equivalent to those according to the process pattern A. Conductivity according to the process pattern C is higher than that according to the process pattern A, and is equivalent to the values of C1220 in Tables 2 to 7. In the metal structure after the spinning process, substantially circular or substantially oval fine precipitates of 2 to 20 nm having Co and P, or fine precipitates in which 90% or more of all the precipitates have a size of 30 nm or less are uniformly dispersed. Also in Test No. 84, 88, and 92 in which the heat treatment is performed at 460° C. for 50 minutes after the spinning process in the process pattern D, the same result as the case of the process pattern C is obtained. It is considered that when the heat treatment is performed before or after the spinning process like the process patterns C and D, the precipitation of P and the like is promoted, thereby improving the conductivity.

Next, the influence of the heating temperature of the ingot before extruding will be described. Tables 14 and 15 show data at the time when the ingot heating temperature is changed in the process patterns A and D, using the first to fourth invention alloys.

TABLE 14

| | | | | Unprocessed Tube Size | | Drawing Portion Size | | | | |
|---|---|---|---|---|---|---|---|---|---|---|
| | | | | Outer | | Outer | | Pressure Resistance | | |
| | Alloy No. | Process Pattern | Test No. | Diameter mm | Thickness mm | Diameter Mm | Thickness mm | PI (B) | PI (0.5%) | PI (1%) |
| First Inv. | 1 | A1 | 201 | 50 | 1 | 14 | 1.1 | 1120 | 1025 | 1065 |
| Alloy | | A | 202 | 50 | 1 | 14 | 1.1 | 1050 | 955 | 995 |
| | | A2 | 203 | 50 | 1 | 14 | 1.1 | 990 | 895 | 945 |
| Second | 4 | A1 | 204 | 30 | 0.4 | 11 | 0.7 | 1088 | 1028 | 1050 |
| Inv. | | A | 205 | 30 | 0.4 | 11 | 0.7 | 1035 | 968 | 998 |
| Alloy | | | | | | | | | | |
| Third | 7 | A1 | 206 | 50 | 1 | 14 | 1.1 | 1255 | 1180 | 1210 |
| Inv. | | A | 207 | 50 | 1 | 14 | 1.1 | 1175 | 1095 | 1135 |
| Alloy | | | | | | | | | | |
| Fourth | 10 | A1 | 208 | 50 | 1 | 14 | 1.1 | 1130 | 1025 | 1080 |
| Inv. | | A | 209 | 50 | 1 | 14 | 1.1 | 1090 | 1000 | 1060 |
| Alloy | | | | | | | | | | |
| Second | 4 | D1 | 210 | 30 | 1 | 12 | 1.3 | 1086 | 975 | 1008 |

TABLE 14-continued

| | | | | | | | | | | |
|---|---|---|---|---|---|---|---|---|---|---|
| Inv. Alloy | | D | 211 | 30 | 1 | 12 | 1.3 | 1035 | 900 | 957 |
| Fourth | 10 | D1 | 212 | 50 | 1 | 14 | 1.1 | 1135 | 1000 | 1090 |
| Inv. Alloy | | D | 213 | 50 | 1 | 14 | 1.1 | 1095 | 940 | 1050 |

| | | Recrystallization Ratio (%) | | | | | | | |
|---|---|---|---|---|---|---|---|---|---|
| | | | Drawing-Processed Portion | | | Avg. of Heat-Influenced Portion and Process End Portion | Crystal Grain Diameter | Precipitates (Process End Portion) | |
| | Alloy No. | Straight Tube Portion | Heat-Influenced Portion | Process End Portion | Process Center Portion | (Drawing-Processed Portion) | Process Center Portion μm | Avg. Diameter nm | 30 nm or less % |
| First Inv. | 1 | 0 | 0 | 5 | 100 | 3 | 10 | 2.9 | 99 |
| Alloy | | 0 | 0 | 10 | 100 | 5 | 14 | 3.5 | 99 |
| | | 0 | 0 | 15 | 100 | 8 | 17 | 4.4 | 98 |
| Second | 4 | 0 | 0 | 5 | 100 | 3 | 7.5 | | |
| Inv. Alloy | | 0 | 0 | 5 | 100 | 3 | 10 | | |
| Third | 7 | 0 | 0 | 2 | 100 | 1 | 7.5 | | |
| Inv. Alloy | | 0 | 0 | 5 | 100 | 3 | 10 | | |
| Fourth | 10 | 0 | 0 | 5 | 100 | 3 | 7.5 | 3.1 | 99 |
| Inv. Alloy | | 0 | 0 | 10 | 100 | 5 | 10 | 3.4 | 99 |
| Second | 4 | 0 | 0 | 5 | 100 | 3 | 10 | | |
| Inv. Alloy | | 0 | 0 | 10 | 100 | 5 | 14 | | |
| Fourth | 10 | 0 | 0 | 5 | 100 | 3 | 7.5 | | |
| Inv. Alloy | | 0 | 0 | 10 | 100 | 5 | 10 | | |

TABLE 15

| | | | | Precipitates (Process Center Portion) | | Vickers Hardness (HV) | | | |
|---|---|---|---|---|---|---|---|---|---|
| | | | | | | | Drawing-Processed Portion | | |
| | Alloy No. | Process Pattern | Test No. | Avg. Diameter nm | 30 nm or less % | Straight Tube Portion | Heat-Influenced Portion | Process End Portion | Process Center Portion |
| First Inv. | 1 | A1 | 201 | 11 | 99 | 150 | 147 | 115 | 74 |
| Alloy | | A | 202 | 13 | 98 | 148 | 143 | 108 | 72 |
| | | A2 | 203 | 14 | 97 | 145 | 136 | 104 | 70 |
| Second | 4 | A1 | 204 | 11 | 98 | 159 | 154 | 120 | 77 |
| Inv. Alloy | | A | 205 | 12 | 97 | 156 | 149 | 111 | 74 |
| Third | 7 | A1 | 206 | 10 | 99 | 170 | 168 | 126 | 76 |
| Inv. Alloy | | A | 207 | 14 | 96 | 167 | 163 | 118 | 74 |
| Fourth | 10 | A1 | 208 | 11 | 99 | 155 | 150 | 118 | 69 |
| Inv. Alloy | | A | 209 | 12 | 97 | 151 | 146 | 110 | 68 |
| Second | 4 | D1 | 210 | 7 | 100 | 145 | 146 | 116 | 78 |
| Inv. Alloy | | D | 211 | 8 | 100 | 142 | 142 | 109 | 89 |
| Fourth | 10 | D1 | 212 | 6 | 99 | 147 | 149 | 125 | 94 |
| Inv. Alloy | | D | 213 | 8 | 99 | 144 | 145 | 116 | 88 |

TABLE 15-continued

| | | Conductivity (% IACS) | | | | 700° C. 20 Sec. Vickers Hardness (HV) | | Recrystallization Ratio (%) |
|---|---|---|---|---|---|---|---|---|
| | | | Drawing-Processed Portion | | | Drawing-Processed Portion | | |
| | Alloy No. | Straight Tube Portion | Heat-Influenced Portion | Process End Portion | Process Center Portion | Heat-Influenced Portion | Process End Portion | Heat-Influenced Portion |
| First Inv. | 1 | 50 | 61 | 71 | 66 | 142 | 112 | 0 |
| Alloy | | 53 | 63 | 71 | 66 | 137 | 105 | |
| | | 55 | 67 | 73 | 67 | 129 | 100 | 0 |
| Second | 4 | 49 | 58 | 65 | 62 | 144 | 114 | |
| Inv. | | 53 | 60 | 66 | 62 | 141 | 109 | |
| Alloy | | | | | | | | |
| Third | 7 | 49 | 63 | 72 | 69 | 157 | 122 | |
| Inv. | | 52 | 66 | 73 | 70 | 153 | 115 | |
| Alloy | | | | | | | | |
| Fourth | 10 | 48 | 60 | 69 | 69 | 141 | 115 | 0 |
| Inv. | | 53 | 62 | 70 | 68 | 137 | 107 | 0 |
| Alloy | | | | | | | | |
| Second | 4 | 76 | 78 | 79 | 71 | 141 | 114 | 0 |
| Inv. | | 81 | 82 | 77 | 73 | 133 | 105 | |
| Alloy | | | | | | | | |
| Fourth | 10 | 75 | 76 | 77 | 73 | 141 | 119 | 0 |
| Inv. | | 78 | 79 | 77 | 75 | 138 | 113 | 0 |
| Alloy | | | | | | | | |

The ingot heating temperature of the process patterns A and D was 850° C. In the process patterns A1 and D1, the ingot heating temperature was 910° C., and in the process pattern A2, the ingot heating temperature was 830° C. When the heating temperature is high, the Vickers hardness is high and thus the pressure resistance is high. It is considered that the reason is that when the heating temperature is high, more amounts of Co, P, and the like are further solid-dissolved, the recrystallization is slightly delayed, the obtained precipitated grains become fine, and the crystal grain diameter becomes small. When the heating temperature is high, the conductivity of the straight tube portion 7 is slightly low. It is considered that the reason is that a great amount of Co and P are solid-dissolved.

The characteristics of the high function copper tube according to the embodiment will be described with reference to the above-described assessment results. The high function copper tube is cooled from the temperature after the hot extruding to 600° C. at 10 to 3000° C./second. Then, the workability of 70% or more is added by the cold drawing or the like, and the strength is increased by the process hardening. Accordingly, it is possible to perform the high-speed spinning process performed thereafter because of the high strength, even when the thickness is small. In the state of the unprocessed tube after the cold rolling process, Co, P, and the like are satisfactorily solid-dissolved. At a part of the copper tube, there are fine precipitates including Co and P of about 10 nm, and occasionally, the fine precipitates include Ni and Fe. Since the thermal conductivity of the copper tube, in which Co, P, and the like are sufficiently solid-dissolved, that is, before the drawing process, is low. Accordingly, heat is not diffused at the time of the spinning process or brazing. Therefore, it is easy to perform the process, and the increase in temperature of the process end portion 5 or the heat-influenced portion 6 is little. Even at the time of the brazing, it is not necessary to perform great preheating, and thus the increase in temperature of the process end portion 5 or the heat-influenced portion 6 is suppressed. As described above, since the thermal conductivity of the copper tube before the drawing process is low, it is easy to process the copper tube. In addition, the thermal conductivity of the processed portion after the drawing process is improved by the process heat, and thus the copper tube is suitable for the pressure-resistance and heat-transfer vessel.

When the spinning process is performed, the temperature of the process center portion 4 is increased to 800 to 950° C. by the process heat. Since recrystallization is started at about 750° C., the deformation resistance is rapidly decreased in the course of the process, thereby obtaining workability equivalent to phosphorus deoxidized copper. Since the recrystallization ratio of the process end portion 5 having low workability and a small thickness as compared with the process center portion 4 is low, the deformation resistance is high even at the time of the spinning process. For this reason, even when large torque occurs in the course of the spinning process, no distortion and no bucking occur. Similarly, the temperature of the heat-influenced portion 6 is increased to 500° C. or higher, and substantially 700° C., the strength of the material is high since the heat-influenced portion 6 is hardly recrystallized. In addition, even when the heat-influenced portion 6 is heated at 700° C. for 20 seconds, the strength at the time of the heating to 700° C. is high since the recrystallization ratio is low. Accordingly, since the strength of a part having no relation with deformation or a part having little deformation in the course of the spinning process is high, no defect in the spinning process occurs in the case of a small thickness. The recrystallized grains of the process center portion 4 have fine grains diameter since the growth of the crystal grains is suppressed by the aforementioned fine precipitates of Co, P, and the like. The process center portion 4 is subjected to the drawing by the spinning process, and thus the outer diameter thereof becomes small and the thickness becomes large. In addition, the strength is high due to the fine recrystallized grains. Accordingly, even when internal pressure is applied thereto, no burst occurs at this part. Therefore, there is no great influence on the pressure resistance of the pressure-resistance and heat-transfer vessel.

In the process end portion 5 and the heat-influenced portion 6, the spinning process does not cause decrease of the outer diameter, and cause just little increase of the thickness. However, in the state of the unprocessed tube after the drawing, most of Co, P, and the like are sufficiently solid-dissolved since the sensitivity of solution is insensitive similarly with the above-described process center portion 4. Since the increase of the temperature by the spinning process is about 500 to 750° C., the movement of atoms of Co and the like is started before the recrystallization in the course of the increase of the temperature. The fine precipitates of Co, P, Ni, Fe, and the like are precipitated, thereby delaying the recrystallization. The invention alloy is hardly recrystallized at 700° C. or 750° C. for ten several seconds or several seconds, and thus considerable softening does not occur. As described above, the recrystallization of the process end portion 5 and the heat-influenced portion 6 deteriorate. Since the softening caused by restoration phenomenon or the like occurring before the recrystallization is substantially offset by the precipitation of Co, P, and the like, the strength of the unprocessed tube is kept, thereby improving the strength. In addition, the thermal conductivity is also improved by the precipitation of Co, P, and the like.

Since Co, P, and the like are precipitated by the heat treatment at 350 to 600° C. for 10 to 300 minutes after the spinning process, the strength is improved. In addition, the thermal conductivity becomes equivalent to that of the known C1220 based on pure copper. At the high-temperature increased part in the process center portion 4, a great amount of Co, P, and the like are solid-dissolved by the air cooling after the spinning process, since Co, P, and the like are precipitated by this heat treatment and thus the thermal conductivity and strength are improved. The process end portion 5 or the heat-influenced portion 6, the temperature of which had been increased up to the verge of the high temperature state (800° C. or higher), was in a state where a great amount of Co, P, and the like was solid-dissolved in the state of the unprocessed tube. Accordingly, the strength and thermal conductivity are improved by the precipitation hardening caused by the heat treatment. The straight tube portion 7 to which the process heat is not applied is considerably process-hardened, and matrix is softened by the heat treatment. However, the softening degree is more than or equivalent to the hardening degree caused by the precipitation. Accordingly, the straight tube portion 7 is slightly softened or has the equivalent strength, and the thermal conductivity of the straight tube portion 7 is improved. Since the process deformation is restored by the heat treatment, ductility is improved.

Even when the heat treatment is performed before the spinning process, it is possible to obtain the same effect as the case of performing the heat treatment after the spinning process. The pressure-resistance and heat-transfer vessel is subjected to brazing or welding with another member after the spinning process, thereby obtaining the same effect as the case of performing the heat treatment, at the process end portion 5 or the heat-influenced portion 6 by the heat, even when the heat treatment is not performed. However, considering heat diffusion at the time of the spinning process or brazing, it is preferable to perform the heat treatment later.

As described above, the high function copper tube according to the embodiment has the high strength in the state of the unprocessed tube after the drawing by the process hardening, and is hardly recrystallized at the temperature of about 750° C. or lower. Accordingly, it is possible to perform the high-speed spinning process even when the thickness is small. The spinning-processed part excluding the process end portion 5 is recrystallized, and thus satisfactory workability is obtained at the time of the spinning process. After the spinning process, the diameter of the recrystallized grains of the process center portion 4 is small, and thus the strength is high. In addition, the recrystallization ratio of the process end portion or the heat-influenced portion 6 is low, and thus the strength is high. Co, P, and the like are precipitated by the influence of the process heat, and thus the softening phenomenon caused by the process heat of the spinning process is suppressed to the minimum. In addition, since Co, P, and the like are precipitated by the heat treatment before the spinning process or after the spinning process, the tube member is enhanced and the thermal conductivity is improved. As described above, the high function copper tube has the high strength, that is, high pressure resistance. Accordingly, the thickness of the pressure-resistance and heat-transfer vessel can be reduced to ½ to ⅓ as compared with the case of using the known C1220, and thus it is possible to produce the pressure-resistance and heat-transfer vessel with low cost. In addition, the weight becomes light as the thickness of the pressure-resistance and heat-transfer vessel becomes small, the number of the members for holing the pressure-resistance and heat-transfer vessel is reduced, thereby reducing the cost. Accordingly, it is possible to make the heat exchanger portion compact.

Next, the process pattern E that is a modified example of the high function copper tube according to the embodiment will be described. In the modified example, the recrystallization annealing was performed at 530° C. for 5 hours in the step of the outer diameter of 50 mm and the thickness 3 mm in the course of the drawing process of the process pattern A. An unprocessed tube having an outer diameter of 30 mm and a thickness of 1.25 mm was produced by cold drawing, and then the unprocessed tube was subjected to drawing into an outer diameter of 12.3 mm and a thickness of 1.3 mm by a spinning process. Tables 16 and 17 show the test result of the modified example and the comparative process pattern A.

TABLE 16

| | | | | Unprocessed Tube Size | | Drawing Portion Size | | | | |
|---|---|---|---|---|---|---|---|---|---|---|
| | | | | Outer | | Outer | | Pressure Resistance | | |
| | Alloy No. | Process Pattern | Test No. | Diameter mm | Thickness mm | Diameter mm | Thickness mm | PI (B) | PI (0.5%) | PI (1%) |
| Second Inv. Alloy | 4 | E | 101 | 30 | 1.3 | 12 | 1.3 | 993 | 891 | 951 |
| Fourth Inv. Alloy | 10 | E | 102 | 30 | 1.3 | 12 | 1.3 | 972 | 870 | 936 |

TABLE 16-continued

| | | | | | | | | | | |
|---|---|---|---|---|---|---|---|---|---|---|
| Second Inv. Alloy | 4 | A | 31 | 30 | 1.3 | 12 | 1.3 | 1032 | 939 | 990 |

| | | Recrystallization Ratio (%) | | | | | | | |
|---|---|---|---|---|---|---|---|---|---|
| | | | Drawing-Processed Portion | | | Avg. of Heat-Influenced Portion and Process End Portion | Crystal Grain Diameter Process | Precipitates (Process End Portion) | |
| | Alloy No. | Straight Tube Portion | Heat-Influenced Portion | Process End Portion | Process Center Portion | (Drawing-Processed Portion) | Center Portion μm | Avg. Diameter nm | 30 nm or less % |
| Second Inv. Alloy | 4 | 0 | 0 | 15 | 100 | 8 | 14 | | |
| Fourth Inv. Alloy | 10 | 0 | 0 | 10 | 100 | 5 | 10 | | |
| Second Inv. Alloy | 4 | 0 | 0 | 10 | 100 | 5 | 14 | | |

TABLE 17

| | | | | Precipitates (Process Center Portion) | | Vickers Hardness (HV) | | | |
|---|---|---|---|---|---|---|---|---|---|
| | | | | | | | Drawing-Processed Portion | | |
| | Alloy No. | Process Pattern | Test No. | Avg. Diameter Nm | 30 nm or less % | Straight Tube Portion | Heat-Influenced Portion | Process End Portion | Process Center Portion |
| Second Inv. Alloy | 4 | E | 101 | 9 | 98 | 148 | 141 | 105 | 71 |
| Fourth Inv. Alloy | 10 | E | 102 | 8 | 99 | 149 | 143 | 106 | 72 |
| Second Inv. Alloy | 4 | A | 31 | | | 151 | 145 | 109 | 71 |

| | | Conductivity (% IACS) | | | | 700° C. 20 Sec. Vickers Hardness (HV) | | 700° C. 20 Sec. Recrystallization Ratio (%) |
|---|---|---|---|---|---|---|---|---|
| | | | Drawing-Processed Portion | | | Drawing-Processed Portion | | |
| | Alloy No. | Straight Tube Portion | Heat-Influenced Portion | Process End Portion | Process Center Portion | Heat-Influenced Portion | Process End Portion | Heat-Influenced Portion |
| Second Inv. Alloy | 4 | 83 | 83 | 73 | 69 | | | |
| Fourth Inv. Alloy | 10 | 80 | 81 | 72 | 70 | | | |
| Second Inv. Alloy | 4 | 54 | 63 | 69 | 65 | 140 | 106 | |

The metal structure before the cold drawing was observed after the recrystallization annealing. Substantially circular or substantially oval fine precipitates of 2 to 20 nm having Co and P were uniformly precipitated, or fine precipitates in which 90% or more of all precipitates have a size of 30 nm or less were uniformly precipitated. All of pressure resistance, a recrystallization ratio, and Vickers hardness were slightly poorer than or equivalent to those of the process pattern A, and were much better than those of deoxidized copper. Conductivity was equivalent to that of C1220 shown in Table 3, which is high. It is considered that this is due to the precipitation of P and the like by the recrystallization annealing. As described above, even when the heat treatment process is performed in the course of the drawing process, the satisfactory result is obtained. Accordingly, it is possible to produce the tube using low-power drawing equipment.

In the embodiment, the high function copper tube, in which the recrystallization ratio of the metal structure of the drawing-processed portion was 50% or less, or the recrystallization ratio of the heat-influenced portion was 20% or less, was obtained (see Test No. 1 to 11 in Tables 2 and 3, Test No. 21 to 24 in Tables 4 and 5, Test No. 31 to 35 in Tables 6 and 7, and Test No. 41 to 55 in Tables 8 and 9, etc.).

The high function copper tube, in which the value of Vickers hardness (HV) of the drawing-processed portion after the heating at 700° C. for 20 seconds was 90 or more, or was 80% or more of the value of Vickers hardness before the heating, was obtained (see Test No. 1 to 3 and 5 to 7 in Tables 2 and 3, Test No. 31 in Tables 6 and 7, and Test No. 41 to 43, 46, and 49 to 51 in Tables 8 and 9, etc.).

The high function copper tube, in which the value of the burst pressure index $PI_B$ was 600 or more, was obtained (see Test No. 1 to 11 in Tables 2 and 3, Test No. 21 to 24 in Tables 4 and 5, Test No. 31 to 35 in Tables 6 and 7, and Test No. 41 to 55 in Tables 8 and 9, etc.).

The high function copper tube, in which the value of the 0.5% deformation pressure index $PI_{05\%}$ was 300 or more, or the value of the 1% deformation pressure index $PI_{1\%}$ was 350 or more, was obtained (see Test No. 1 to 11 in Tables 2 and 3, Test No. 21 to 24 in Tables 4 and 5, Test No. 31 to 35 in Tables 6 and 7, and Test No. 41 to 55 in Tables 8 and 9, etc.).

The high function copper tube, in which the substantially circular or substantially oval fine precipitates of 2 to 20 nm having Co and P were uniformly dispersed in the metal structure before the drawing process, or 90% or more of all precipitates were uniformly dispersed as the fine precipitates having the size of 30 nm or less, was obtained (see Test No. 101 and 102 in Tables 16 and 17).

The high function copper tube, in which the substantially circular or substantially oval fine precipitates of 2 to 20 nm having Co and P were uniformly dispersed in the metal structure of the process end portion and the process center portion after the drawing process or after the brazing with another copper tube, or 90% or more of all precipitates were uniformly dispersed as the fine precipitates having the size of 30 nm or less, was obtained (see Test No. 1, 3, 7, and 10 in Tables 2 and 3, Test No. 43, 44, 46, and 49 in Tables 8 and 9, Test No. 81 to 84 and 88 to 92 in Tables 12 and 13, and Test No. 201 to 213 in Tables 14 and 15, etc.).

The high function copper tube, in which the metal structure of the process center portion was recrystallized, and the crystal grain diameter was 3 to 35 μm, was obtained (see Test No. 1 to 11 in Tables 2 and 3, Test No. 21 to 24 in Tables 4 and 5, Test No. 31 to 35 in Tables 6 and 7, and Test No. 41 to 55 in Tables 8 and 9, etc.).

Second Embodiment

A high function copper tube according to a second embodiment of the invention will be described. In the embodiment, differently from the first embodiment, a pressure-resistance and heat-transfer vessel is produced by a cold drawing process such as a swaging process, "Hera-shibori", and roll forming, instead of the spinning process.

Example

The same high function copper tubes as the example of the first embodiment were produced, and then the pressure-resistance and heat-transfer vessels were produced by the cold drawing process. Three produced pressure-resistance and heat-transfer vessels were prepared for each production condition. As for two vessels among them, one end of the drawing tube portion 3 was connected to a jig made of brass for a pressure-resistance test by phosphorus copper lead (7 mass % P—Cu), and the other end was sealed up by phosphorus copper lead. As for one of the two vessels, all properties such as metal structure, Vickers hardness, and conductivity were examined. As for the other of the two vessels, pressure resistance was examined. The vessel was not subjected to brazing, a part corresponding to the process end portion 5 and the heat-influenced portion 6 was cut with the pressure-resistance and heat-transfer vessels as it was, was immersed in salt bath heated to 700° C. for 20 seconds, was taken out, and then was subjected to air cooling. Then, heat resistance was assessed from the Vickers hardness and a recrystallization ratio after the heating at 700° C. for 20 seconds, and the pressure resistance. Tables 18 and 19 show the result of the pressure-resistance and heat-transfer vessel produced according to the above-described method.

TABLE 18

| | | | | Unprocessed Tube Size | | Drawing Portion Size | | | | |
|---|---|---|---|---|---|---|---|---|---|---|
| | | | | Outer | | Outer | | Pressure Resistance | | |
| | Alloy No. | Process | Test No. | Diameter mm | Thickness mm | Diameter mm | Thickness mm | PI (B) | PI (0.5%) | PI (1%) |
| First Inv. Alloy | 1 | Hera-Forming | 111 | 50 | 1 | 14.3 | 1.1 | 1035 | 965 | 1000 |
| Fourth Inv. Alloy | 10 | Hera-Forming | 112 | 50 | 1 | 14.3 | 1.1 | 1075 | 1010 | 1055 |
| Comp. | 23 | Hera-Forming | 113 | 50 | 1 | 14.3 | 1.1 | 530 | 205 | 260 |
| C1220 | 31 | Hera-Forming | 114 | 50 | 1.5 | 16 | 1.5 | 443 | 117 | 153 |
| Second Inv. Alloy | 4 | Extruding and then Heat Treatment, Hera-Forming | 115 | 30 | 1 | 12.5 | 1.1 | 1056 | 990 | 1041 |
| Fourth Inv. | 10 | Hera-Forming + Heat Treatment | 116 | 50 | 1 | 14.3 | 1.1 | 1085 | 1000 | 1055 |
| Alloy | 10 | Heating 910° C., Hera-Forming | 117 | 50 | 1 | 14.3 | 1.1 | 1110 | 1050 | 1075 |

TABLE 18-continued

| | | | | | | | | | | |
|---|---|---|---|---|---|---|---|---|---|---|
| Fourth Inv. Alloy | 8 | Swaging | 121 | 50 | 1 | 14.3 | 1.1 | 960 | 900 | 930 |
| C1220 | 31 | Swaging | 122 | 50 | 1.5 | 16 | 1.5 | 437 | 120 | 163 |
| Second Inv. Alloy | 4 | Extruding and then Heat Treatment, Swaging | 123 | 30 | 1 | 12.5 | 1.2 | 1032 | 969 | 1014 |
| Fourth Inv. Alloy | 8 | Heating 910° C., Swaging | 124 | 50 | 1 | 14.3 | 1.1 | 1010 | 940 | 970 |
| First Inv. Alloy | 3 | Roll-Forming | 131 | 50 | 1 | 27.8 | 1.4 | 1215 | 1160 | 1195 |

| | | Recrystallization Ratio (%) | | | | | | |
|---|---|---|---|---|---|---|---|---|
| | | | Drawing-Processed Portion | | | | Avg. of Heat-Influenced Portion and Process End Portion | Crystal Grain Diameter |
| | Alloy No. | Straight Tube Portion | Heat-Influenced Portion | Process End Portion | Process Center Portion | (Drawing-Processed Portion) | Process Center Portion μm |
| First Inv. Alloy | 1 | 0 | 0 | 20 | 100 | 10 | 14 |
| Fourth Inv. Alloy | 10 | 0 | 0 | 20 | 100 | 10 | 10 |
| Comp. | 23 | 0 | 100 | 100 | 100 | 100 | 80 |
| C1220 | 31 | 0 | 100 | 100 | 100 | 100 | 120 |
| Second Inv. Alloy | 4 | | | | | | |
| Fourth Inv. Alloy | 10 | 0 | 0 | 20 | 100 | 10 | 10 |
| | 10 | 0 | 0 | 15 | 100 | 8 | 7.5 |
| Fourth Inv. Alloy | 8 | 0 | 0 | 30 | 100 | 15 | 12 |
| C1220 | 31 | 0 | 100 | 100 | 100 | 100 | 120 |
| Second Inv. Alloy | 4 | | | | | | |
| Fourth Inv. Alloy | 8 | 0 | 0 | 20 | 100 | 10 | 10 |
| First Inv. Alloy | 3 | | | | | | |

TABLE 19

| | | | | Precipitates (Process Center Portion) | | Vickers Hardness (HV) | | | |
|---|---|---|---|---|---|---|---|---|---|
| | | | | | | | Drawing-Processed Portion | | |
| | Alloy No. | Process | Test No. | Avg. Diameter nm | 30 nm or less % | Straight Tube Portion | Heat-Influenced Portion | Process End Portion | Process Center Portion |
| First Inv. Alloy | 1 | Hera-Forming | 111 | 12 | 98 | 150 | 135 | 113 | 73 |
| Fourth Inv. Alloy | 10 | Hera-Forming | 112 | 11 | 98 | 152 | 139 | 115 | 72 |
| Comp. | 23 | Hera-Forming | 113 | | | 123 | 57 | 51 | 45 |
| C1220 | 31 | Hera-Forming | 114 | | | 98 | 41 | 38 | 35 |
| Second Inv. Alloy | 4 | Extruding and then Heat Treatment, Hera-Forming | 115 | | | | | | |
| Fourth Inv. Alloy | 10 | Hera-Forming + Heat Treatment | 116 | | | 149 | 138 | 114 | 76 |
| | 10 | Heating 910° C., Hera-Forming | 117 | | | 155 | 144 | 122 | 76 |

TABLE 19-continued

| | | | | | | | |
|---|---|---|---|---|---|---|---|
| Fourth Inv. Alloy | 8 | Swaging | 121 | 145 | 131 | 108 | 69 |
| C1220 | 31 | Swaging | 122 | 96 | 42 | 39 | 34 |
| Second Inv. Alloy | 4 | Extruding and then Heat Treatment, Swaging | 123 | | | | |
| Fourth Inv. Alloy | 8 | Heating 910° C., Swaging | 124 | 147 | 134 | 112 | 72 |
| First Inv. Alloy | 3 | Roll-Forming | 131 | | | | |

| | | Conductivity (% IACS) | | | | 700° C. 20 Sec. Vickers Hardness (HV) | | |
|---|---|---|---|---|---|---|---|---|
| | | | Drawing-Processed Portion | | | Drawing-Processed Portion | | Recrystallization Ratio (%) |
| | Alloy No. | Straight Tube Portion | Heat-Influenced Portion | Process End Portion | Process Center Portion | Heat-Influenced Portion | Process End Portion | Heat-Influenced Portion |
| First Inv. Alloy | 1 | 52 | 64 | 71 | 67 | 134 | 134 | 0 |
| Fourth Inv. Alloy | 10 | 52 | 63 | 70 | 69 | 136 | 135 | 0 |
| Comp. | 23 | 61 | 69 | 71 | 68 | 56 | 55 | 100 |
| C1220 | 31 | 85 | 87 | 87 | 87 | 42 | 41 | 100 |
| Second Inv. Alloy | 4 | | | | | | | |
| Fourth Inv. | 10 | 78 | 78 | 76 | 72 | 137 | 136 | 0 |
| Alloy | 10 | 47 | 60 | 69 | 70 | 141 | 140 | 0 |
| Fourth Inv. Alloy | 8 | 54 | 64 | 71 | 68 | 132 | 131 | 0 |
| C1220 | 31 | 85 | 87 | 87 | 87 | 41 | 42 | 100 |
| Second Inv. Alloy | 4 | | | | | | | |
| Fourth Inv. Alloy | 8 | 50 | 61 | 70 | 68 | 134 | 135 | 0 |
| First Inv. Alloy | 3 | | | | | | | |

Production conditions are shown as follows.

(1) In Test No. 111 to 114, the unprocessed tube produced according to the process pattern A is subjected to a "Hera-Shibori" drawing process. In Test No. 111 and 112, the invention alloys of Alloy No. 1 and 10 are used. In Test No. 113, the comparative alloy of Alloy No. 23 is used. In Test No. 114, C1220 is used. In Test No. 115, the invention alloy of Alloy No. 4 is used, and the unprocessed tube produced according to the process pattern E is subjected to a "Hera-Shibori" drawing process. In Test No. 116, a heat treatment is performed at 460° C. for 50 minutes after Test No. 112. In Test No. 117, the invention alloy of Alloy No. 10 is used, and the unprocessed tube in which the ingot heating temperature is 910° C. in the process pattern A is subjected to a "Hera-Shibori" drawing process.

(2) In Test No. 121 and 122, the unprocessed tube produced according to the process pattern A is subjected to a swaging process. In Test No. 121, the invention alloy of Alloy No. 8 is used. In Test No. 122, C1220 is used. In Test No. 123, the invention alloy of Alloy No. 4 is used, and the unprocessed tube produced according to the process pattern E is subjected to a spinning process. In Test No. 124, the invention alloy of Alloy No. 8 is used, and the unprocessed tube in which the ingot heating temperature is 910° C. in the process pattern A is subjected to a spinning process.

(3) In Test No. 131, the invention alloy of Alloy No. 3 is used, and the unprocessed tube produced according to the process pattern A is subjected to a roll forming process.

The shape of the drawing copper tube (pressure-resistance and heat-transfer vessel) produced according to these process methods is the same as that of the tube produced by the spinning process. However, unlike in the case of the spinning process, there is little difference in the thickness of the drawing tube portion, as compared with the tube before the process. That is, since the thickness does not increase, connection with a copper tube for piping, that is, a heat influence caused by brazing increases, as compared with the pressure-resistance and heat-transfer vessel produced by the spinning process. The pressure resistance of the copper tube (pressure-resistance and heat-transfer vessel) drawn by the "Hera-Shibori" drawing process or the swaging process using C1220 is equivalent to that of the tube produced by the spinning process, or is rather lower than that. Since there is no difference in thickness between the drawing portion and the unprocessed tube, the temperature of the drawing-processed portion 8 close to the connection part to another tube by brazing particularly increases and thus the crystal grains are coarsened. Since the pressure resistance is affected by an outer diameter and a thickness, the temperature of the part corresponding to the process end portion or the heat-influenced portion is increased due to the heat influence of the brazing by the spinning process. As a result, recrystallization occurs, and it is considered that poor pressure resistance is obtained because the crystal grains are coarsened.

The invention alloy is recrystallized at the drawing tube portion 3 close to the connection part since the temperature becomes a high temperature of about 800° C. by the brazing. However, burst does not occur in the vicinity of the connection part at the time of the pressure-resistance test, since the crystal grains are fine and the diameter is small. The temperature of the process end portion 5 is increased to about 750° C., and the process end portion is softened, but is not burst, due to keeping the high strength, since the diameter of the material is small. The temperature of the heat-influenced portion 6 is increased to about 700° C., and matrix is slightly softened, but is hardly recrystallized. When the pressure-resistance and heat-transfer vessel is burst by internal pressure, the burst occurs mostly at the heat-influenced portion 6. Since the pressure resistance is affected by an outer diameter, the strength of the process end portion 5 and the heat-influenced portion 6 is equivalent to the strength of the process end portion 5 and the heat-influenced portion 6 of the spinning process. Accordingly, it is considered that the pressure resistance is much higher than that of C1220.

In the invention alloy after the brazing, Vickers hardness of each portion is high and a non-recrystallization ratio of the part corresponding to the process end portion 5 is low, similarly with the pressure-resistance and heat-transfer vessel with the same composition produced by the spinning process. The Vickers hardness of all the invention alloys after heating at 700° C. for 20 seconds was 130 or more, but the Vickers hardness of C1220 was about 40. All the comparative alloys of Alloy No. 13 were also recrystallized at the time of heating at 700° C., and the Vickers hardness thereof was also low. As described above, in the pressure-resistance and heat-transfer vessel produced by forming or the like with "hera", the invention alloy has excellent heat resistance. In the metal structure of the heat-influenced portion after the heating at 700° C., all the recrystallization ratios were 0%, that is, there was no recrystallization. Accordingly, high heat resistance and high pressure resistance are kept.

The invention alloy has the high strength and is a material having sufficient ductility. Accordingly, the invention alloy can be relatively easily formed into a drawing copper tube by the cold drawing process such as the swaging process and "Hera-shibori". In these processing methods, heat is hardly generated. Accordingly, the whole of the pressure-resistance and heat-transfer vessel has the same property as the straight tube portion 6 of the pressure-resistance and heat-transfer vessel according to the first embodiment. Even when the brazing is performed, the part corresponding to the heat-influenced portion 6 is hardly recrystallized, and the recrystallization ratio of the part corresponding to the process end portion 5 is 10 to 30%, thereby keeping the high strength. Therefore, any pressure-resistance and heat-transfer vessel has the high pressure resistance equivalent to that of the drawing copper tube produced by the spinning process. In the spinning process, when the degree of the drawing process is low and thus little heat is generated, the same result as the case of the cold process is obtained. As described above, using the invention alloy, it is possible to produce the pressure-resistance and heat-transfer vessel even by the cold process, and to obtain satisfactory properties.

In the embodiment, the high function copper tube, in which the recrystallization ratio of the metal structure of the drawing-processed portion is 50% or less, or the recrystallization ratio of the heat-influenced portion is 20% or less, was obtained (see Test No. 111, 112, 116, 117, 121, and 124 in Tables 18 and 19).

As a modified example of the second embodiment, the test result of a pressure-resistance and heat-transfer vessel produced by brazing two unprocessed tubes, end portions of which is processed by the cold process, is shown in Table 20.

TABLE 20

| | | | | Pressure Resistance | | |
|---|---|---|---|---|---|---|
| | Alloy No. | Process | Test No. | PI (B) | PI (0.5%) | PI (1%) |
| Fourth Inv. Alloy | 10 | Brazing | 141 | 902 | 842 | 886 |
| Third Inv. Alloy | 14 | Brazing | 142 | 970 | 895 | 943 |

Figure 5:
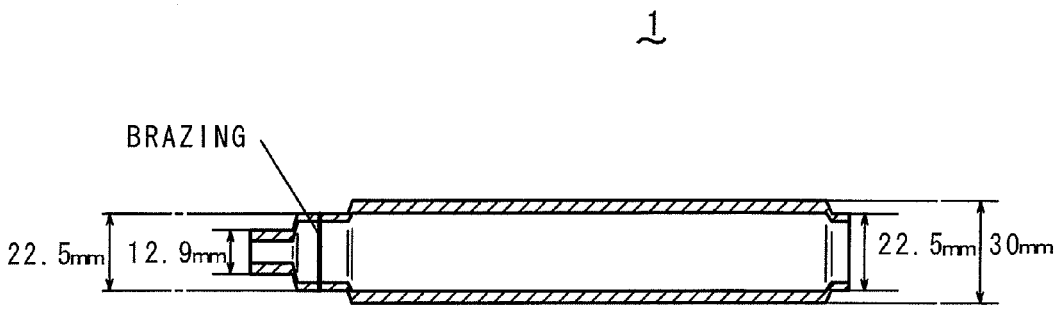
FIG. 5 is a side sectional view of a pressure-resistance and heat-transfer vessel according to a modified example of a second embodiment of the invention.

FIG. 5 shows a side sectional view of the pressure-resistance and heat-transfer vessel. Unprocessed tubes produced by the process pattern A having an outer diameter of 25 mm and a thickness of 2 mm and having an outer diameter of 50 mm and a thickness of 1.5 mm were subjected to complete recrystallization annealing at 550° C. for 4 hours. After the annealing, the unprocessed tube having the outer diameter of 25 mm was drawn to have an outer diameter of 12.9 mm and a thickness of 1.6 mm and was cut to have a length of 25 mm, and one end thereof was expanded by a press process to have an outer diameter of 22.5 mm. The unprocessed tube having the outer diameter of 50 mm was drawn to have an outer diameter of 30 mm and a thickness of 1.25 mm after the annealing and was cut to have a length of 150 mm, and then both ends thereof were subjected to drawing by a press process to have an outer diameter of 22.5 mm. The two tubes having the outer diameter of 22.5 mm were connected each other with both ends by brazing, thereby producing a pressure-resistance and heat-transfer vessel. The produced pressure-resistance and heat-transfer vessel has high pressure resistance. As described above, the invention alloy has high pressure resistance, even when the brazing is performed after the cold process.

The invention is not limited to the configuration of the above-described various embodiments, and may be variously modified within the scope of the concept of the invention. For example, tube rolling may be performed to make a tube thin, instead of the drawing. In addition, a spinning process accompanying no great heat, a cold ironing process, and a forming process using a roll or a press may be performed instead of the swaging. Moreover, welding may be performed instead of the brazing. The shape of the pressure-resistance and heat-transfer vessel is not limited to the shape of drawing one end or both ends of the tube. For example, the drawing portion may be formed in a 2-step shape.

Priority is claimed on Japanese Patent Application No. 2007-331080, the content of which is incorporated herein by reference.

DRAWINGS

Miscellaneous Comments

[FIG. 1]

3: DRAWING TUBE PORTION

7: STRAIGHT TUBE PORTION

6: HEAT-INFLUENCED PORTION
5: PROCESS END PORTION
4: PROCESS CENTER PORTION
8: DRAWING-PROCESSED PORTION
3: DRAWING TUBE PORTION
2: UNPROCESSED TUBE PORTION

[FIG. 2]
PROCESS PATTERN A
INGOT HEATING (850° C.)
EXTRUSION
WATER COOLING (100° C./s)
DRAWING
SPINNING PROCESS
PROCESS PATTERN B
INGOT HEATING (850° C.)
EXTRUSION
AIR COOLING (30° C./s)
DRAWING
SPINNING PROCESS
PROCESS PATTERN C
INGOT HEATING (850° C.)
EXTRUSION
WATER COOLING (100° C./s)
DRAWING
HEAT TREATMENT AT 395° C. FOR 240 min
SPINNING PROCESS
PROCESS PATTERN D
INGOT HEATING (850° C.)
EXTRUSION
WATER COOLING (100° C./s)
DRAWING
SPINNING PROCESS
HEAT TREATMENT AT 460° C. FOR 50 min

[FIG. 3A]
FIRST INVENTION ALLOY, TEST No. 1
PROCESS CENTER PORTION, 14 μm

[FIG. 3B]
FIRST INVENTION ALLOY, TEST No. 1
PROCESS END PORTION, NON-RECRYSTALLIZATION

[FIG. 3C]
FIRST INVENTION ALLOY, TEST No. 1
HEAT-INFLUENCED PORTION, NON-RECRYSTALLIZATION

[FIG. 3D]
FIRST INVENTION ALLOY, TEST No. 1
STRAIGHT TUBE PORTION, NON-RECRYSTALLIZATION

[FIG. 3E]
C1220, TEST No. 14
PROCESS CENTER PORTION, 120 μm

[FIG. 3F]
C1220, TEST No. 14
PROCESS END PORTION, 32 μm

[FIG. 3G]
C1220, TEST No. 14
HEAT-INFLUENCED PORTION, 17 μm

[FIG. 3H]
C1220, TEST No. 14
STRAIGHT TUBE PORTION, NON-RECRYSTALLIZATION

Figure 4A:
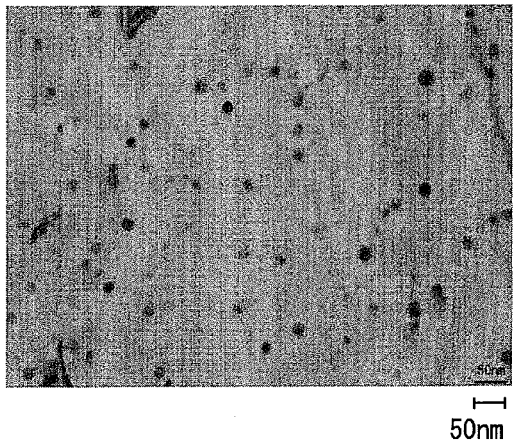
FIG. 4A is a metal structure photograph of a process center portion of the pressure-resistance and heat-transfer vessel.

[FIG. 4A]
FOURTH INVENTION ALLOY, TEST No. 7
PROCESS CENTER PORTION, 12 nm

Figure 4B:
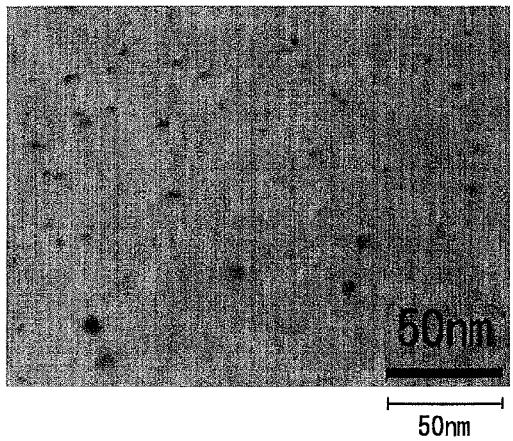
FIG. 4B is a metal structure photograph of a process end portion.

[FIG. 4B]
FIRST INVENTION ALLOY, TEST No. 1
PROCESS END PORTION, 3.5 nm

[FIG. 5]
BRAZING

What is claimed is:

1. A high strength and high thermal conductivity copper alloy tube subjected to a drawing process, wherein the copper alloy tube has an alloy composition comprising:
Co of 0.12 to 0.32 mass %;
P of 0.042 to 0.095 mass %;
Sn of 0.005 to 0.30 mass %; and
at least one of Ni of 0.01 to 0.15 mass % and Fe of 0.005 to 0.07 mass %,
wherein relationships of $3.0 \leq ([Co]+0.85\times[Ni]+0.75\times[Fe]-0.007)/([P]-0.008) \leq 6.2$ and $0.015 \leq 1.5\times[Ni]+3\times[Fe] \leq [Co]$ are satisfied, wherein [Co] is the content in mass % of Co, [Ni] is the content in mass % of Ni, [Fe] is the content in mass % of Fe, and [P] is the content in mass % of P, and the remainder includes Cu and inevitable impurities,
wherein a recrystallization ratio of a metal structure of a drawing-processed portion of the copper alloy tube subjected to the drawing process is 50% or less, or a recrystallization ratio of a heat-influenced portion subject to the drawing process is 20% or less.

2. The high strength and high thermal conductivity copper alloy tube according to claim 1, wherein the alloy composition further comprises at least one of Zn of 0.001 to 0.5 mass %, Mg of 0.001 to 0.2 mass %, and Zr of 0.001 to 0.1 mass %.

3. The high strength and high thermal conductivity copper alloy tube according to claim 2, wherein a value of Vickers hardness (HV) of a drawing-processed portion subjected to the drawing process after heating at 700° C. for 20 seconds is 80% or more of a value of Vickers hardness (HV) before the heating.

4. The high strength and high thermal conductivity copper alloy tube according to claim 2, wherein the drawing process is a spinning process, and
wherein a recrystallization ratio of a metal structure of a drawing-processed portion subjected to the spinning process is 50% or less.

5. The high strength and high thermal conductivity copper alloy tube according to claim 2, wherein the drawing process is a cold-drawing process, and
wherein a recrystallization ratio of a metal structure of a drawing-processed portion subjected to the cold-drawing process is 50% or less, or a recrystallization ratio of a heat-influenced portion subject to the cold-drawing process is 20% or less, after brazing with another copper tube at end portions of the drawing-processed portion and the heat-influenced portion.

6. The high strength and high thermal conductivity copper alloy tube according to claim 2, wherein a value of $(P_B \times D/T)$ is 600 or more, where D (mm) is an outer diameter of a straight tube portion which is not subjected to the drawing process, T (mm) is a thickness, and $P_B$ (MPa) is a burst pressure that is a pressure at the time of bursting the straight tube portion by applying internal pressure.

7. The high strength and high thermal conductivity copper alloy tube according to claim 2,
wherein a value of $(P_{0.5\%} \times D/T)$ is 300 or more, where D (mm) is an outer diameter of a straight tube portion which is not subjected to the drawing process, T (mm) is a thickness, and $P_{0.5\%}$ (MPa) is a 0.5% deformation pressure that is a pressure at the time of deforming the outer diameter by 0.5% by applying internal pressure, or wherein a value of ($P_{1\%}$×D/T) is 350 or more, where $P_{1\%}$ (MPa) is a 1% deformation pressure that is a pressure at the time of deforming the outer diameter by 1% by applying internal pressure.

8. The high strength and high thermal conductivity copper alloy tube according to claim 2, wherein a metal structure of a process center portion subjected to the drawing process is recrystallized, and has a crystal grain diameter of 3 to 35 μm.

9. The high strength and high thermal conductivity copper alloy tube according to claim 2, wherein the copper alloy tube is used as a pressure-resistance and heat-transfer vessel of a heat exchanger.

10. The high strength and high thermal conductivity copper alloy tube according to claim 1, wherein a value of Vickers hardness (HV) of a drawing-processed portion subjected to the drawing process after heating at 700° C. for 20 seconds is 80% or more of a value of Vickers hardness (HV) before the heating.

11. The high strength and high thermal conductivity copper alloy tube according to claim 1, wherein the drawing process is a spinning process, and wherein a recrystallization ratio of a metal structure of a drawing-processed portion subjected to the spinning process is 50% or less.

12. The high strength and high thermal conductivity copper alloy tube according to claim 1, wherein the drawing process is a cold-drawing process, and wherein a recrystallization ratio of a metal structure of a drawing-processed portion subjected to the cold-drawing process is 50% or less, or a recrystallization ratio of a heat-influenced portion subject to the cold-drawing process is 20% or less, after brazing with another copper tube at end portions of the drawing-processed portion and the heat-influenced portion.

13. The high strength and high thermal conductivity copper alloy tube according to claim 1, wherein a value of ($P_B$×D/T) is 600 or more, where D (mm) is an outer diameter of a straight tube portion which is not subjected to the drawing process, T (mm) is a thickness, and $P_B$ (MPa) is a burst pressure that is a pressure at the time of bursting the straight tube portion by applying internal pressure.

14. The high strength and high thermal conductivity copper alloy tube according to claim 1, wherein a value of ($P_{0.5\%}$×D/T) is 300 or more, where D (mm) is an outer diameter of a straight tube portion which is not subjected to the drawing process, T (mm) is a thickness, and $P_{0.5}$% (MPa) is a 0.5% deformation pressure that is a pressure at the time of deforming the outer diameter by 0.5% by applying internal pressure, or wherein a value of ($P_{1\%}$×D/T) is 350 or more, where $P_{1\%}$ (MPa) is a 1% deformation pressure that is a pressure at the time of deforming the outer diameter by 1% by applying internal pressure.

15. The high strength and high thermal conductivity copper alloy tube according to claim 1, wherein a metal structure of a process center portion subjected to the drawing process is recrystallized, and has a crystal grain diameter of 3 to 35 μm.

16. The high strength and high thermal conductivity copper alloy tube according to claim 1, wherein the copper alloy tube is used as a pressure-resistance and heat-transfer vessel of a heat exchanger.

17. A high strength and high thermal conductivity copper alloy tube subjected to a drawing process, wherein the copper alloy tube has an alloy composition comprising:

Co of 0.12 to 0.32 mass %;

P of 0.042 to 0.095 mass %;

Sn of 0.005 to 0.30 mass %; and at least one of Ni of 0.01 to 0.15 mass % and Fe of 0.005 to 0.07 mass %, wherein relationships of 3.0≤([Co]+0.85×[Ni]+0.75×[Fe]−0.007)/([P]−0.008)≤6.2 and 0.015≤1.5×[Ni]+3×[Fe]≤[Co] are satisfied, wherein [Co] is the content in mass % of Co, [Ni] is the content in mass % of Ni, [Fe] is the content in mass % of Fe, and [P] is the content in mass % of P, and the remainder includes Cu and inevitable impurities, wherein a recrystallization ratio of a metal structure of a drawing-processed portion of the copper alloy tube subjected to the drawing process is 50% or less, or a recrystallization ratio of a heat-influenced portion subject to the drawing process is 20% or less, and wherein in a metal structure of a process end portion and a process center portion before the drawing process, after the drawing process, or after brazing with another copper tube, circular or oval fine precipitates having a size of 2 to 20 nm containing Co and P are uniformly dispersed, or 90% or more of all precipitates are uniformly dispersed as fine precipitates having a size of 30 nm or less.

18. A high strength and high thermal conductivity copper alloy tube subjected to a drawing process, wherein the copper alloy tube has an alloy composition comprising:

Co of 0.12 to 0.32 mass %;

P of 0.042 to 0.095 mass %;

Sn of 0.005 to 0.30 mass %;

at least one of Ni of 0.01 to 0.15 mass % and Fe of 0.005 to 0.07 mass %; and at least one of Zn of 0.001 to 0.5 mass %, Mg of 0.001 to 0.2 mass %, and Zr of 0.001 to 0.1 mass %, wherein relationships of 3.0≤([Co]+0.85×[Ni]+0.75×[Fe]−0.007)/([P]−0.008)≤6.2 and 0.015≤1.5×[Ni]+3×[Fe]≤[Co] are satisfied, wherein [Co] is the content in mass % of Co, [Ni] is the content in mass % of Ni, [Fe] is the content in mass % of Fe, and [P] is the content in mass % of P, and the remainder includes Cu and inevitable impurities, wherein a recrystallization ratio of a metal structure of a drawing-processed portion of the copper alloy tube subjected to the drawing process is 50% or less, or a recrystallization ratio of a heat-influenced portion subject to the drawing process is 20% or less, and wherein in a metal structure of a process end portion and a process center portion before the drawing process, after the drawing process, or after brazing with another copper tube, circular or oval fine precipitates having a size of 2 to 20 nm containing Co and P are uniformly dispersed, or 90% or more of all precipitates are uniformly dispersed as fine precipitates having a size of 30 nm or less.

19. A high strength and high thermal conductivity copper alloy tube subjected to a drawing process, wherein the copper alloy tube has an alloy composition comprising:

Co of 0.12 to 0.32 mass %;

P of 0.042 to 0.095 mass %;

Sn of 0.005 to 0.30 mass %; and at least one of Ni of 0.01 to 0.15 mass % and Fe of 0.005 to 0.07 mass %, wherein relationships of 3.0≤([Co]+0.85×[Ni]+0.75×[Fe]−0.007)/([P]—0.008)≤6.2 and 0.015≤1.5×[Ni]+3×[Fe]≤[Co] are satisfied, wherein [Co] is the content in mass % of Co, [Ni] is the content in mass % of Ni, [Fe] is the content in mass % of Fe, and [P] is the content in mass % of P, and the remainder includes Cu and inevitable impurities, wherein a recrystallization ratio of a metal structure of a drawing-processed portion of the copper alloy tube subjected to the drawing process is 50% or less, and a recrystallization ratio of a heat-influenced portion subject to the drawing process is 0%, and wherein in a metal structure of a process end portion and a process center portion before the drawing process, after the drawing process, or after brazing with another copper tube, circular or oval fine precipitates having a size of 2 to 20 nm containing Co, P, and either one of Ni or Fe are uniformly dispersed, or 90% or more of all precipitates are uniformly dispersed as fine precipitates having a size of 30 nm or less.

20. A high strength and high thermal conductivity copper alloy tube subjected to a drawing process, wherein the copper alloy tube has an alloy composition comprising:

Co of 0.12 to 0.32 mass %;

P of 0.042 to 0.095 mass %;

Sn of 0.005 to 0.30 mass %;

at least one of Ni of 0.01 to 0.15 mass % and Fe of 0.005 to 0.07 mass %; and at least one of Zn of 0.001 to 0.5 mass %, Mg of 0.001 to 0.2 mass %, and Zr of 0.001 to 0.1 mass %, wherein relationships of $3.0 \leq ([Co]+0.85\times[Ni]+0.75\times[Fe]-0.007)/([P]-0.008) \leq 6.2$ and $0.015 \leq 1.5\times[Ni]+3\times[Fe] \leq [Co]$ are satisfied, wherein [Co] is the content in mass % of Co, [Ni] is the content in mass % of Ni, [Fe] is the content in mass % of Fe, and [P] is the content in mass % of P, and the remainder includes Cu and inevitable impurities, wherein a recrystallization ratio of a metal structure of a drawing-processed portion of the copper alloy tube subjected to the drawing process is 50% or less, and a recrystallization ratio of a heat-influenced portion subject to the drawing process is 0%, and wherein in a metal structure of a process end portion and a process center portion before the drawing process, after the drawing process, or after brazing with another copper tube, circular or oval fine precipitates having a size of 2 to 20 nm containing Co, P, and either one of Ni or Fe are uniformly dispersed, or 90% or more of all precipitates are uniformly dispersed as fine precipitates having a size of 30 nm or less.

21. A high strength and high thermal conductivity copper alloy tube subjected to a drawing process, wherein the copper alloy tube has an alloy composition comprising:

Co of 0.12 to 0.32 mass %;

P of 0.042 to 0.095 mass %;

Sn of 0.005 to 0.30 mass %; and at least one of Ni of 0.01 to 0.15 mass % and Fe of 0.005 to 0.07 mass %, wherein relationships of $3.0 \leq ([Co]+0.85\times[Ni]+0.75\times[Fe]-0.007)/([P]-0.008) \leq 6.2$ and $0.015 \leq 1.5\times[Ni]+3\times[Fe] \leq [Co]$ are satisfied, wherein [Co] is the content in mass % of Co, [Ni] is the content in mass % of Ni, [Fe] is the content in mass % of Fe, and [P] is the content in mass % of P, and the remainder includes Cu and inevitable impurities, wherein conductivity of the copper tube before the drawing process is 60% IACS or less, wherein a recrystallization ratio of a metal structure of a drawing-processed portion of the copper alloy tube subjected to the drawing process is 50% or less, or a recrystallization ratio of a heat-influenced portion subject to the drawing process is 20% or less, and wherein in a metal structure of a process end portion and a process center portion before the drawing process, after the drawing process, or after brazing with another copper tube, circular or oval fine precipitates having a size of 2 to 20 nm containing Co and P are uniformly dispersed, or 90% or more of all precipitates are uniformly dispersed as fine precipitates having a size of 30 nm or less.

22. A high strength and high thermal conductivity copper alloy tube subjected to a drawing process, wherein the copper alloy tube has an alloy composition comprising:

Co of 0.12 to 0.32 mass %;

P of 0.042 to 0.095 mass %;

Sn of 0.005 to 0.30 mass %;

at least one of Ni of 0.01 to 0.15 mass % and Fe of 0.005 to 0.07 mass %; and at least one of Zn of 0.001 to 0.5 mass %, Mg of 0.001 to 0.2 mass %, and Zr of 0.001 to 0.1 mass %, wherein relationships of $3.0 \leq ([Co]+0.85\times[Ni]+0.75\times[Fe]-0.007)/([P]-0.008) \leq 6.2$ and $0.015 \leq 1.5\times[Ni]+3\times[Fe] \leq [Co]$ are satisfied, wherein [Co] is the content in mass % of Co, [Ni] is the content in mass % of Ni, [Fe] is the content in mass % of Fe, and [P] is the content in mass % of P, and the remainder includes Cu and inevitable impurities, wherein conductivity of the copper tube before the drawing process is 60% IACS or less, wherein a recrystallization ratio of a metal structure of a drawing-processed portion of the copper alloy tube subjected to the drawing process is 50% or less, or a recrystallization ratio of a heat-influenced portion subject to the drawing process is 20% or less, and wherein in a metal structure of a process end portion and a process center portion before the drawing process, after the drawing process, or after brazing with another copper tube, circular or oval fine precipitates having a size of 2 to 20 nm containing Co and P are uniformly dispersed, or 90% or more of all precipitates are uniformly dispersed as fine precipitates having a size of 30 nm or less.

* * * * *